United States Patent [19]

Mitsui et al.

[11] Patent Number: 4,681,837

[45] Date of Patent: Jul. 21, 1987

[54] SILVER HALIDE COLOR PHOTOGRAPHIC MATERIAL

[75] Inventors: Akio Mitsui; Noboru Ohta, both of Kanagawa, Japan

[73] Assignee: Fuji Photo Film Co., Ltd., Kanagawa, Japan

[21] Appl. No.: 787,820

[22] Filed: Oct. 15, 1985

[30] Foreign Application Priority Data

Oct. 12, 1984 [JP] Japan ..... 59-213977

[51] Int. Cl.[4] ..... G03C 7/32

[52] U.S. Cl. ..... 430/504; 430/506

[58] Field of Search ..... 430/504, 506

[56] References Cited

U.S. PATENT DOCUMENTS 4,170,479 10/1979 Usami ..... 430/506

4,564,587 1/1986 Watanabe et al. ..... 430/506

4,594,314 6/1986 Kimuta et al. ..... 430/506

*Primary Examiner*—Richard L. Schilling

*Attorney, Agent, or Firm*—Sughrue, Mion, Zinn, Macpeak & Seas

[57] ABSTRACT

A silver halide color photographic light-sensitive material comprising at least three silver halide emulsion layer units sensitive to blue, green and red light, respectively, at least one of the silver halide emulsion layer units having at least two layers which are different in sensitivity from each other and containing at least Coupler (A′) described below and Coupler (B) described below, and one of said layers is in charge of color formation of the highest density portion in the characteristics curve of these layers and contains Coupler (B) described below which forms a dye having the maximum absorption wavelength different from a dye formed from Coupler (A) described below in an amount of at least 30 mol % of the total amount of the couplers included therein, wherein Coupler (A) denotes (i) a coupler which forms a dye having a maximum absorption in the wavelength range from 400 nm to less than (the maximum absorption wavelength of a dye formed from Coupler (A′)+5) nm, when employed in a blue-sensitive layer unit, (ii) a coupler which forms a dye having the maximum absorption in the wavelength range from 510 nm to less than (the maximum absorption wavelength of a dye formed from Coupler (A′)+5) nm, when employed in a green-sensitive layer unit, or (iii) a coupler which forms a dye having the maximum absorption in the wavelength range from more than (the maximum absorption wavelength of a dye formed from Coupler (A′−5) nm to 700 nm, when employed in a red-sensitive layer unit; Coupler (A′) denotes a coupler which is employed in the largest amount by mol among the couplers contained in one or more layers other than the layer which is in charge of color formation of the highest density portion in a characteristic curve of the silver halide emulsion layer unit, or Coupler (B) denotes a coupler which forms a dye having the maximum absorption in the wavelength range other than that of a dye formed from Coupler (A).

The silver halide color photographic light-sensitive material is excellent in color reproducibility over a wide range from low density areas to high density areas and stability.

29 Claims, 1 Drawing Figure

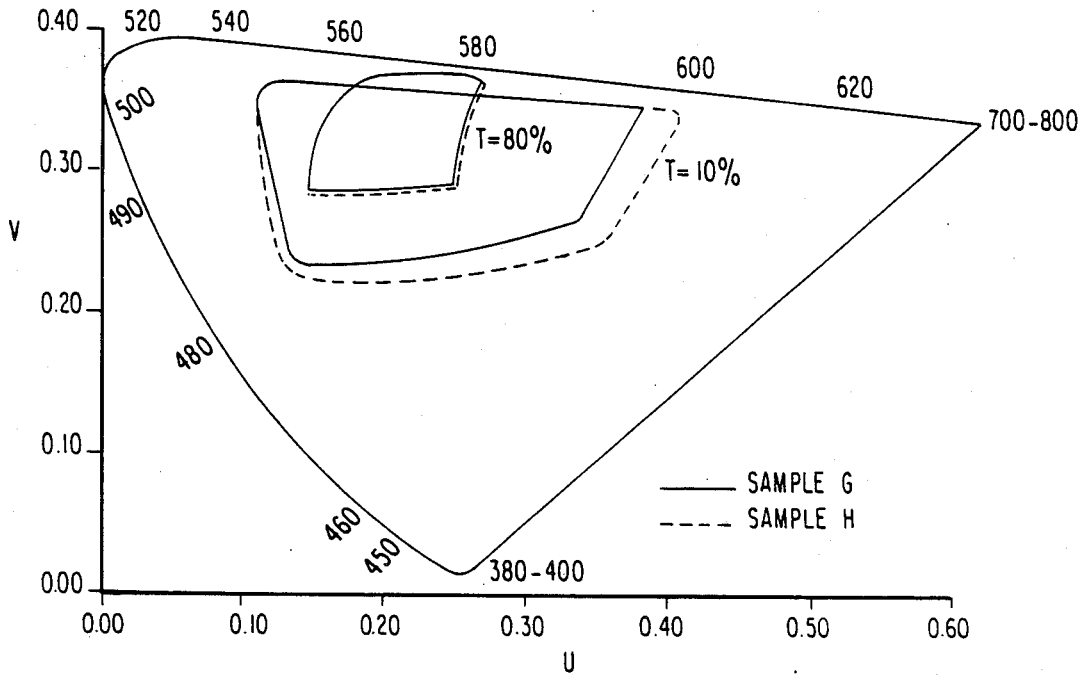
0.40
0.30
0.20
0.10
0.00
V
520
540
560
580
600
620
700-800
500
490
480
460
450
380-400
T=80%
T=10%
SAMPLE G
SAMPLE H
0.00
0.10
0.20
0.30
0.40
0.50
0.60
U

SILVER HALIDE COLOR PHOTOGRAPHIC MATERIAL

FIELD OF THE INVENTION

The present invention relates to a silver halide color photographic material and, more particularly, to a silver halide color photographic material having improved color reproducibility in a wide range from low density areas to high density areas.

BACKGROUND OF THE INVENTION

Silver halide color photographic materials comprise a support coated with at least three silver halide emulsion layers which are sensitive to three primary colors of blue, green and red light, respectively. Each of the emulsion layers may be composed of two or more layers. Further, various auxiliary layers are often provided in addition to the emulsion layers.

Such silver halide color photographic materials are widely used for various purposes including for usual photographing. In such cases wherein objects to be recorded as images of color photographs are limited to natural things, it is not very necessary to consider the color reproducible range and conventional techniques are sufficient for such purposes.

However, synthetic dyes or pigments which are obtained artificially have recently come into widespread use and as a result objects to be photographed having colors of high saturation are frequently encountered. Therefore, it has been desired to develop a silver halide color photographic material having a considerably wide color reproducible range of a color image in order to faithfully reproduce these colors of high saturation.

In fact, various attempts for improvement have been heretofore made to fulfill this requirement. For instance, a method intending to obtain a sharper spectral absorption with less secondary absorption than prior art by using a coupler which forms a dye having an improved spectral absorption, for example, a pivaloyl type 2-equivalent yellow coupler as described in U.S. Pat. No. 3,408,194, etc., an anilino type magenta coupler as described in U.S. Pat. Nos. 3,907,571 and 3,935,015, etc., a pyrazolotriazole type magenta coupler as described in U.S. Pat. No. 3,725,067, etc., a method in which color purity is improved upon development using an interlayer effect as described in Belgian Pat. No. 710,344, West German Pat. No. 2,043,943, etc., or a DIR coupler as described in U.S. Pat. No. 3,227,544, etc., a method for correcting an undesirable absorption of a dye formed using a colored coupler which has an automasking function as described in U.S. Pat. No. 2,455,170, etc., and a method of increasing color separation by means of sharpening the spectral sensitivity of each light-sensitive layer as described in Japenese Patent Application (OPI) No. 77443/82 (the term "OPI" as used herein refers to a "published unexamined Japanese patent application"), etc., are known.

However, desirable color reproducibility is still not achieved with these methods.

Further methods using together two or more couplers which form dyes having spectral absorptions different from each other in the same emulsion layer have been proposed. For example, there are a method for emphasizing color mixing of images by means of mixing a small amount of a different kind of coupler with the main coupler as described in Japanese Patent Publication No. 391/65 and a method for partially improving incompleteness of absorption characteristics of a dye formed from the main coupler by using it together with two or more magenta couplers as described in Japanese Patent Application (OPI) No. 71333/75, etc.

However, these methods also have problems in that the range of density wherein color reproduction is obtainable is narrow, etc.

Moreover, for the purpose of obtaining color images having excellent color reproducibility extending from low density areas to high density areas, a proposal based on the theory of chromatics has been made that the maximum absorption wavelengths of dyes according to the subtractive three primary colors are desirably differentiated in the high density areas from the low density areas as described in *The Color Gamut Obtainable by the Combination of Subtractive Color Dyes*, Photo. Science and Engineering, Vol. 15, No. 5, pages 399–415 (1971).

A method as described in Japanese Patent Publication No. 43887/74 is an example which utilizes the above described theory. More specifically, in a silver halide color photographic material having three silver halide emulsion layers sensitive to three primary colors of blue, green and red, respectively, at least two kinds of couplers differing in coupling rate and forming dyes having the maximum absorption wavelengths different from each other by at least 5 nm are incorporated into the same emulsion layer in order to broaden the range of density wherein color reproduction is practicable.

However, this method is disadvantageous in that couplers which are usable are limited in view of problems in synthesis thereof or their properties other than color formation such as solubility and color stain, etc., and in that change in gradation and deviation in hue, etc., are apt to occur depending on the difference in processing techniques of development because of using together couplers having different coupling rates and, therefore, practical use is difficult. Particularly, a remarkably large decrease in color density due to poor stirring in a processing bath at development is a big problem in practice.

SUMMARY OF THE INVENTION

Therefore, an object of the present invention is to provide a silver halide color photographic material which provides color images having improved color reproducibility in a wide range from low density areas to high density areas and high saturation and is excellent in practicability and stability.

Other objects of the present invention will become apparent from the following description and examples.

These objects of the present invention can be accomplished with a silver halide color photographic material comprising a support having thereon at least three silver halide emulsion layer units sensitive to three primary colors of blue, green and red light, respectively, at least one of the silver halide emulsion layer units having at least two layers which are different in sensitivity from each other and containing at least Coupler (A') described below and Coupler (B) described below, and one of said layers is in charge of color formation of the highest density portion in the characteristic curve of these layers and contains Coupler (B) described below which forms a dye having the maximum absorption wavelength different from a dye formed from Coupler (A) described below in an amount of at least 30 mol% of the total amount of the couplers included therein, wherein Coupler (A) denotes (i) a coupler which forms a dye having the maximum absorption in the wavelength range from 400 nm to less than (the maximum absorption wavelength of a dye formed from Coupler (A')+5) nm, when the coupler is employed in a blue-sensitive silver halide emulsion layer unit, (ii) a coupler which forms a dye having the maximum absorption in the wavelength range from 510 nm to less than (the maximum absorption wavelength of a dye formed from Coupler (A')+5) nm, when the coupler is employed in a green-sensitive silver halide emulsion layer unit, or (iii) a coupler which forms a dye having the maximum absorption in the wavelength range from more than (the maximum absorption wavelength of a dye formed from Coupler (A')−5) nm to 700 nm, when the coupler is employed in a red-sensitive silver halide emulsion layer unit; Coupler (A') denotes a coupler which is employed in the largest amount by mol among the couplers contained in one or more layers other than the layer which is in charge of color formation of the highest density portion in a characteristic curve of the silver halide emulsion layer unit; Coupler (B) denotes a coupler which forms a dye having the maximum absorption in the wavelength range other than that of a dye formed from Coupler (A); and the above described Couplers (A), (A') and (B) are substantially colorless and the maximum absorptions of the dyes formed therefrom are present in (i) the wavelength range from 400 nm to 480 nm when they are employed in the blue-sensitive silver halide emulsion layer unit, (ii) the wavelength range from 510 nm to 590 nm when they are employed in the green-sensitive silver halide emulsion layer unit, or (iii) the wavelength range from 600 nm to 700 nm when they are employed in the red-sensitive silver halide emulsion layer unit.

BRIEF DESCRIPTION OF THE DRAWING

FIG. 1 is a graph showing the color range in the (U,V) chromaticity diagram for a visual transmittance (T) of 10% and 80% using the spectral reflective spectra of Sample G for comparison and Sample H according to the present invention of Example 3.

DETAILED DESCRIPTION OF THE INVENTION

The present invention will be explained in detail in the following. The light-sensitive silver halide emulsion layer units according to the present invention mean three light-sensitive silver halide emulsion layer units sensitive to blue, green and red lights in the three primary color method, respectively, and at least one of these units is composed of at least two light-sensitive emulsion layers which are different in sensitivity from each other. The light-sensitive emulsion layer contains a silver halide emulsion spectrally sensitized to the specified wavelength range of blue, green or red and a coupler-in-emulsion type coupler.

In the case of using the light-sensitive emulsion layer having different sensitivities, a gelatin intermediate layer containing a color stain preventing agent, colloidal silver, etc., may be provided between these emulsion layers.

The term "the characteristic curve" used in the present invention means a curve indicating image density as a function of the logarithm of the exposure and is described in detail in T. H. James, *The Theory of the Photographic Process*, Fourth Ed., pages 501–509.

The term "a layer which is in charge of color formation of the highest density portion in the characteristic curve" used in the present invention means a layer which is in charge of color formation of a portion close to the maximum density of the characteristic curve.

Into the layer which is in charge of color formation of the highest density portion in the characteristic curve among these layers of the layer unit, Coupler (B) is incorporated.

Coupler (B) forms a dye having the maximum absorption in the wavelength range other than that of a dye formed from Coupler (A) described hereinafter.

Coupler (B), Coupler (A) and coupler (A') described hereinafter are substantially colorless and the maximum absorptions of the dyes formed therefrom are present in (i) the wavelength range from 400 nm to 480 nm when they are employed in the blue-sensitive silver halide emulsion layer unit, (ii) the wavelength range from 510 nm to 590 nm when they are employed in the green-sensitive silver halide emulsion layer unit, or (iii) the wavelength range from 600 nm to 700 nm when they are employed in the red-sensitive silver halide emulsion layer unit.

The maximum absorption wavelength of a dye formed from the coupler used in the present invention indicates a wavelength of light at which the maximum density is obtained in the absorption spectrum of a dye in the light-sensitive material which is formed upon coupling of the coupler with an oxidation product of a phenylenediamine type color developing agent. The wavelength is changed depending not only on the kind of the couplers but also on the kind of developing agents and the kind and amount of a solvent having a high boiling point for dispersing the coupler in an emulsion layer.

Therefore, the maximum absorption wavelength of a dye formed from the coupler in the present invention denotes a value which is measured in a practical film system, and which is specifically obtained by coating a layer containing the coupler to prepare a film, developing the film with the same developing solution as used for developing the photographic light-sensitive material of the present invention and measuring the film thus processed.

On the premise of the above, Coupler (A) denotes (i) a coupler which forms a dye having the maximum absorption in the wavelength range from 400 nm to less than (the maximum absorption wavelength of a dye formed from Coupler (A')+5) nm, when the coupler is employed in a blue-sensitive silver halide emulsion layer unit, (ii) a coupler which forms a dye having the maximum absorption in the wavelength range from 510 nm to less than (the maximum absorption wavelength of a dye formed from Coupler (A')+5) nm, when the coupler is employed in a green-sensitive silver halide emulsion layer unit, or (iii) a coupler which forms a dye having the maximum absorption in the wavelength range from more than (the maximum absorption wavelength of a dye formed from Coupler (A')−5) nm to 700 nm, when the coupler is employed in a red-sensitive silver halide emulsion layer unit.

The Coupler (A') described above denotes a coupler which is employed in the largest amount by mol among the couplers contained in one or more layers other than the layer which is in charge of color formation of the highest density portion in a characteristic curve of the silver halide emulsion layer unit.

Coupler (B) is a coupler which forms a dye having the maximum absorption in the wavelength range other than that of a dye formed from the above described Coupler (A), and the maximum absorption wavelength formed therefrom is present (i) in the wavelength range from (the maximum absorption wavelength of a dye formed from Coupler (A')+5) nm to 480 nm, when the coupler is employed in a blue-sensitive silver halide emulsion layer unit, (ii) in the wavelength range from (the maximum absorption wavelength of a dye formed from Coupler (A')+5) nm to 590 nm, when the coupler is employed in a green-sensitive silver halide emulsion layer unit, or (iii) in the wavelength range from 600 nm to (the maximum absorption wavelength of a dye formed from Coupler (A')−5) nm, when the coupler is employed in a red-sensitive silver halide emulsion layer unit.

In such cases, a difference between the maximum absorption wavelengths of Coupler (A') and Coupler (B) is sufficiently distinguishable by sight when they differ by more than 2 nm. However, for the purpose of obtaining the improved effect on color reproduction according to the present invention, it is desired that the difference is more than 5 nm, preferably from 5 nm to 40 nm and particularly from 5 nm to 20 nm.

Coupler (B) is incorporated into a layer which is in charge of color formation of the highest density portion in the characteristic curve. An amount of coupler (B) to be added (a total amount to be added when two or more of Coupler (B) are employed) is 30 mol% or more (i.e., from 30 mol% to 100 mol%) and preferably from 50 mol% to 100 mol% based on the total amount of the couplers included in the layer.

Further, when Coupler (B) is incorporated into another layer of the layer unit, it is desirable that an amount to be added is not more than 30 mol% based on the total amount of the couplers included in the layer.

A coupler which may be incorporated into the layer which is in charge of color formation of the highest density portion in the characteristic curve in addition to Coupler (B) is one or more of the above described Coupler (A') and/or Coupler (A).

Into one or more layers other than the layer which is in charge of color formation of the highest density portion in the characteristic curve, at least Coupler (A') is incorporated. More specifically, Coupler (A') alone, Coupler (A') and one or more of Coupler (A) or in place thereof or in addition thereto one or more of Coupler (B) may be incorporated.

As described above, one or more kinds of Coupler (A) may be added to a single layer. Further, Coupler (B) may be used individually or as an appropriate mixture of two or more kinds thereof. That is, when plural couplers which form a dye having the maximum absorption wavelength different by at least 5 nm from that of a dye formed from the above described Coupler (A') are employed at the same time they are all deemed as Coupler (B).

When two or more of Coupler (A') are employed, the term "the maximum absorption wavelength of a dye formed from Coupler (A')" in the above described definition for Coupler (A) means an average value of these maximum absorption wavelengths.

A molar amount (mol%) of couplers when plural Coupler (A) and/or Coupler (B) are employed is calculated from the total amount of each coupler.

Moreover, when two or more of the layers which are in charge of color formation of the highest density portion in the characteristic curve are present, the definition of the amount incorporated of Coupler (B) is applied to each of these layers.

Into the light-sensitive layer, a coupler forming a dye having the maximum absorption in the range other than the above described wavelength may be incorporated in addition to Coupler (A), Coupler (A') and coupler (B) described above, if desired.

An amount of the couplers incorporated into one light-sensitive emulsion layer is from $1\times10^{-3}$ mol to $5\times10^{-1}$ mol and preferably from $1\times10^{-2}$ mol to $5\times10^{-1}$ mol per mol of silver contained therein.

The silver halide color photographic material of the present invention is mainly applied preferably to a photographic light-sensitive material for direct observation of images, such as a color reversal film, a color positive film, a color paper and a color reversal paper, etc.

In the case of a color paper or a color positive film which is used for printing from a color negative film or a cinema negative film, it is preferred that Coupler (A) and in addition Coupler (B) are incorporated into a low-sensitive layer which is in charge of color formation of the highest density portion in the characteristic curve and only Coupler (A') is incorporated into other layers of each light-sensitive emulsion layer unit (composed of two or more layers having different sensitivities).

Further, in the case of a photographic light-sensitive material for directly obtaining a positive image such as a color reversal film or a color reversal paper, etc., it is preferred that Coupler (A) and in addition Coupler (B) are incorporated into a high-sensitive layer which is in charge of color formation of the highest density portion in the characteristic curve and only Coupler (A') is incorporated into other layers of the layer unit.

Furthermore, to a layer containing Coupler (A'), Coupler (A) described above may also be added, if desired.

In any case, an amount of Coupler (B) incorporated into the layer is not less than 30 mol% and preferably not less than 50 mol% of the total amount of couplers incorporated into the layer.

A yellow coupler which is incorporated into the blue-sensitive silver halide emulsion layer unit is preferably selected from those represented by the following general formula (I), (II) or (III):

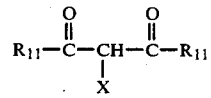
(I)

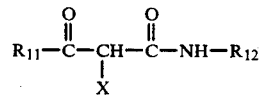
(II)

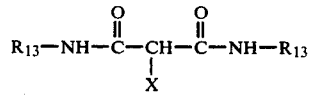
(III)

In the above described general formula (I), (II) or (III), $R_{11}$ represents an aliphatic group, an aromatic group, an alkoxy group or a heterocyclic group, and $R_{12}$ and $R_{13}$ each represents an aromatic group or a heterocyclic group.

The aliphatic group represented by $R_{11}$ is preferably an aliphatic group containing from 1 to 22 carbon atoms, and may have substituents or not, and further, may have a chain form or a cyclic form. Preferable substituents therefor include an alkoxy group, an aryloxy group, an amino group, an acylamino group, a halogen atom, etc., each of which may further have a substituent(s).

Specific examples of aliphatic groups useful for $R_{11}$ include an isopropyl group, an isobutyl group, a tert-butyl group, an isoamyl group, a tert-amyl group, a 1,1-dimethylbutyl group, a 1,1-dimethylhexyl group, a 1,1-diethylhexyl group, a dodecyl group, a hexadecyl group, an octadecyl group, a cyclohexyl group, a 2-methoxyisopropyl group, a 2-phenoxyisopropyl group, a 2-p-tert-butylphenoxyisopropyl group, an α-aminoisopropyl group, an α-(diethylamino)isopropyl group, an α-(succinimido)isopropyl group, an α-(phthalimido)isopropyl group, an α-(benzenesulfonamido)isopropyl group, etc.

In the case that $R_{11}$, $R_{12}$ or $R_{13}$ represents an aromatic group (especially a phenyl group), it may have a substituent. Such an aryl group as a phenyl group, etc., may be substituted with an alkyl group, an alkenyl group, an alkoxygroup, an alkoxycarbonyl group, an alkoxycarbonylamino group, an aliphatic amido group, an alkylsulfamoyl group, an alkylsulfonamido group, an alkylureido group, an alkyl-substituted succinimido group, etc., each containing 32 or less carbon atoms. The alkyl group therein may include an alkyl group which contains an aromatic group such as phenylene in its main chain.

Further, a phenyl group represented by $R_{11}$, $R_{12}$ or $R_{13}$ may be substituted with an aryloxy group, an aryloxycarbonyl group, an arylcarbamoyl group, an arylamido group, an arylsulfamoyl group, an arylsulfonamido group, an arylureido group, etc., each of the aryl moiety of which groups may further be substituted with one or more alkyl groups wherein the number of carbon atoms is from 1 to 22 in total.

Furthermore, a phenyl group represented by $R_{11}$, $R_{12}$ or $R_{13}$ may be substituted with an amino group which includes an amino group substituted with a lower alkyl group having from 1 to 6 carbon atoms, a hydroxy group, a carboxy group, a sulfo group, a nitro group, a cyano group, a thiocyano group or a halogen atom.

In addition, $R_{11}$, $R_{12}$ or $R_{13}$ may represent a substituent formed by condensing a phenyl group and another ring, such as a naphthyl group, a quinolyl group, an isoquinolyl group, a chromanyl group, a coumaranyl group, a tetrahydronaphthyl group, etc. These substituents may further have substituents in themselves.

In the case that $R_{11}$ represents an alkoxy group, the alkyl moiety thereof represents a straight chain or branched chain alkyl group having from 1 to 40 carbon atoms, preferably from 1 to 22 carbon atoms, an alkenyl group, a cyclic alkyl group or a cyclic alkenyl group, each of which may be substituted with a halogen atom, an aryl group, an alkoxy group, etc.

In the case that $R_{11}$, $R_{12}$ or $R_{13}$ represents a heterocyclic group, the heterocyclic group is connected to the carbon atom of the carbonyl group of the acyl moiety or the nitrogen atom of the amido moiety of an α-acylacetamido group through one of the carbon atoms forming the ring. Examples of such heterocyclic rings include thiophene, furan, pyran, pyrrole, pyrazole, pyridine, pyrazine, pyrimidine, pyridazine, indolizine, imidazole, thiazole, oxazole, triazine, thiadiazine, oxazine, etc. These rings may further have substituents on the individual rings.

In the above described general formula (I), (II) or (III), X represents a hydrogen atom or a group capable of being released upon the coupling reaction with an oxidation product of an aromatic primary amine developing agent.

When X represents a group capable of being released (hereinafter referred to as a leaving group), the leaving group includes a group connecting an aliphatic group, an aromatic group, a heterocyclic group, an aliphatic, aromatic or heterocyclic sulfonyl group or an aliphatic, aromatic or heterocyclic carbonyl group with the coupling active carbon atom through an oxygen atom, a nitrogen atom, a sulfur atom or a carbon atom, a halogen atom and an aromatic azo group, etc. The aliphatic group, aromatic group or heterocyclic group included in the leaving group may be substituted with one or more substituents as defined for the above described substituent $R_{11}$. When two or more substituents are present, they may be the same or different.

Specific examples of the leaving groups include a halogen atom (for example, a fluorine atom, a chlorine atom, a bromine atom, etc.), an alkoxy group (for example, an ethoxy group, a dodecyloxy group, a methoxyethylcarbamoylmethoxy group, a carboxypropyloxy group, a methylsulfonylethoxy group, etc.), an aryloxy group (for example, a 4-chlorophenoxy group, a 4-methoxyphenoxy group, a 4-carboxyphenoxy group, etc.), an acyloxy group (for example, an acetoxy group, a tetradecanoyloxy group, a benzoyloxy group, etc.), an aliphatic or aromatic sulfonyloxy group (for example, a methanesulfonyloxy group, a toluenesulfonyloxy group, etc.), an acylamino group (for example, a dichloroacetylamino group, a heptafluorobutylamino group, etc.), an aliphatic or aromatic sulfonamido group (for example, a methanesulfonamino group, a p-toluenesulfonamino group, etc.), an alkoxycarbonyloxy group (for example, an ethoxycarbonyloxy group, a benzyloxycarbonyloxy group, etc.), an aryloxycarbonyloxy group (for example, a phenoxycarbonyloxy group, etc.), an aliphatic, aromatic or heterocyclic thio group (for example, an ethylthio group, a phenylthio group, a tetrazolylthio group, etc.), a carbamoylamino group (for example, an N-methyl-carbamoylamino group, an N-phenylcarbamoylamino group, etc.), a 5-membered or 6-membered nitrogen-containing heterocyclic group (for example, an imidazolyl group, a pyrazolyl group, a triazolyl group, a tetrazolyl group, a 1,2-dihydro-2-oxo-1-pyridyl group, etc.), an imido group (for example, a succinimido group, a hydantoinyl group, etc.) or the like. These groups may be substituted with one or more substituents as defined for the above described substituent $R_{11}$.

Also, an example of a leaving group connecting through a carbon atom is a group of a bis type coupler obtained by condensation of 4-equivalent couplers with an aldehyde or a ketone.

Preferred examples of the group represented by X include a hydrogen atom, a halogen atom, an acylamino group, an imido group, an aliphatic or aromatic sulfonamido group, a 5-membered or 6-membered nitrogen-containing heterocyclic group connecting to the coupling active position through the nitrogen atom thereof, an aryloxy group and an alkoxy group.

The substituent for $R_{11}$, $R_{12}$ or $R_{13}$ of the coupler represented by the above described general formula (I), (II) or (III) may connect with each other or form a divalent group to form a polymer including a dimer or more. The polymer means a compound having two or more coupler skeletons in its molecule and includes a bis compound and a polymer coupler.

The polymer coupler may be a homopolymer consisting of a monomer unit having a coupler skeleton (preferably having a vinyl group) or a copolymer formed from a monomer unit having a coupler skeleton and at least one kind of a non-color-forming ethylenic monomer unit.

Of the yellow couplers represented by the above described general formula (I), (II) or (III), Coupler (A) or Coupler (A') each forming a dye having the maximum absorption in the wavelength range from 400 nm to 480 nm and Coupler (B) which forms a dye having the maximum absorption wavelength at at least 5 nm longer than that of a dye formed from Coupler (A) or Coupler (A') in the case of using it together with Coupler (A) or Coupler (A') each particularly preferred are selected from those described below.

Coupler (A) or Coupler (A') can be a coupler represented by the general formula (I) or (II) described above wherein $R_{11}$ represents an aliphatic group or an alkoxy group, and Coupler (B) can be a coupler represented by the general formula (I) described above wherein one of $R_{11}$ represents an aliphatic group or an alkoxy group and the other of $R_{11}$ represents an aromatic group of a heterocyclic group or a coupler represented by the general formula (III) described above.

Specific examples of particularly preferred compounds among the yellow couplers used in the present invention are set forth below.

(Y-1)

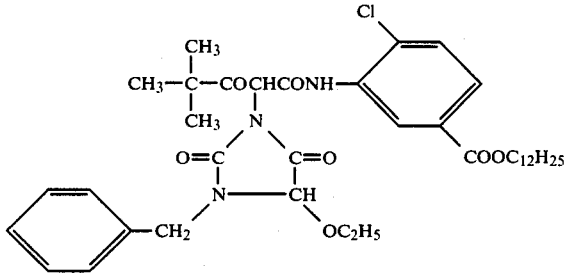

(Y-2)

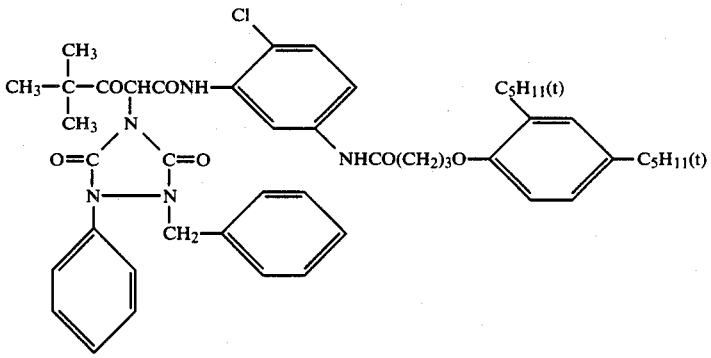

(Y-3)

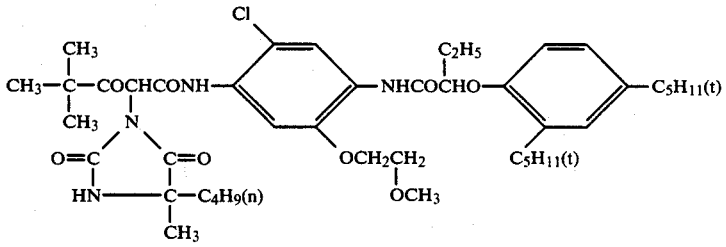

-continued
(Y-4)
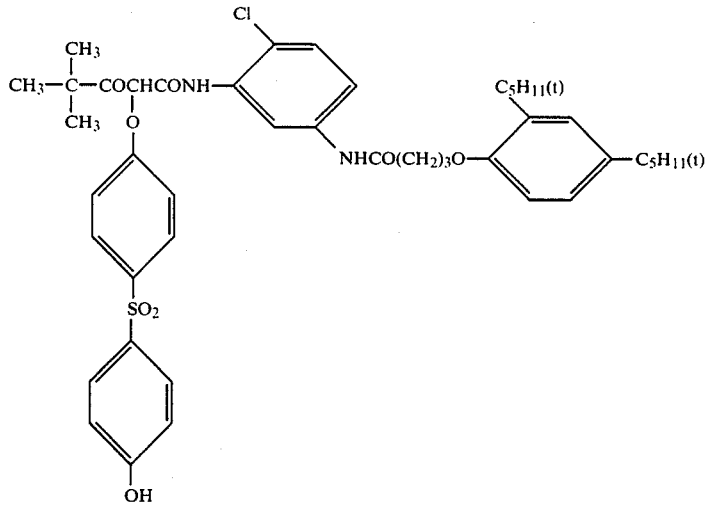
(Y-5)
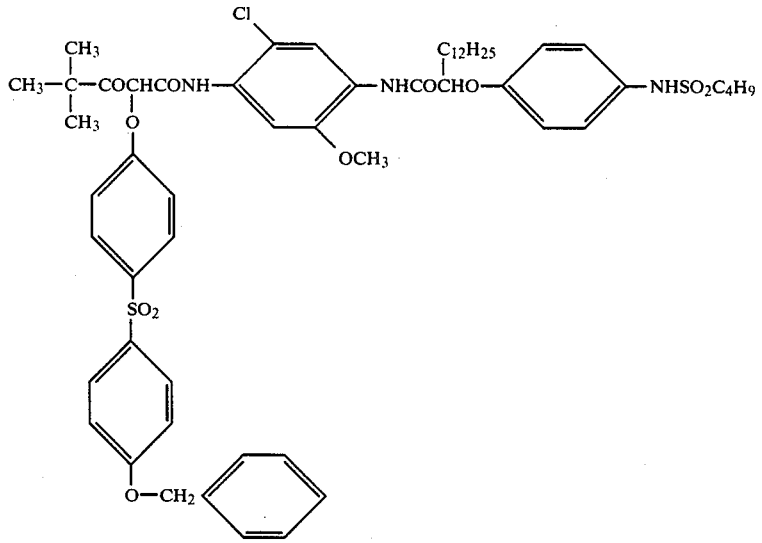
(Y-6)
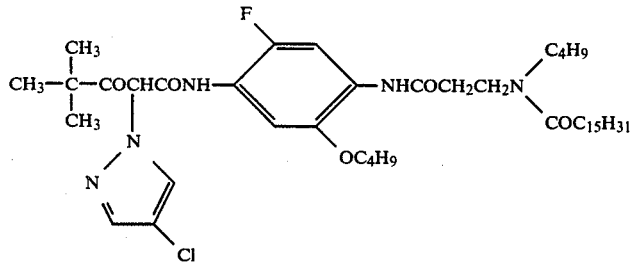
(Y-7)
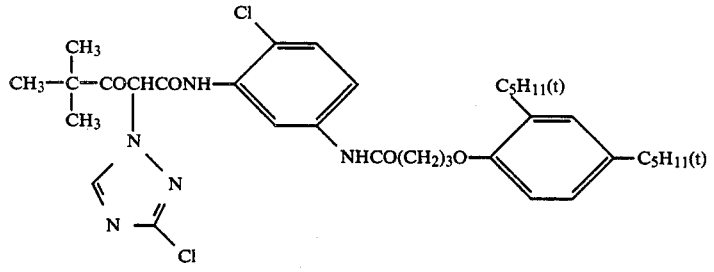

-continued
(Y-8)
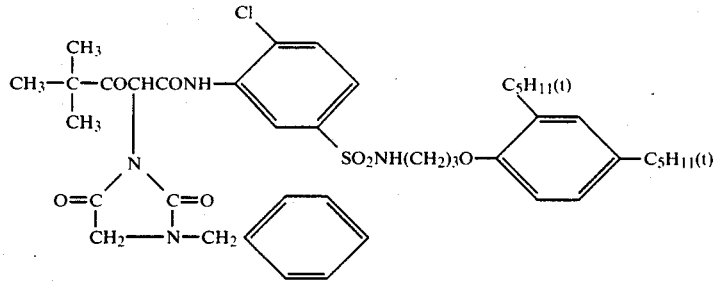
(Y-9)
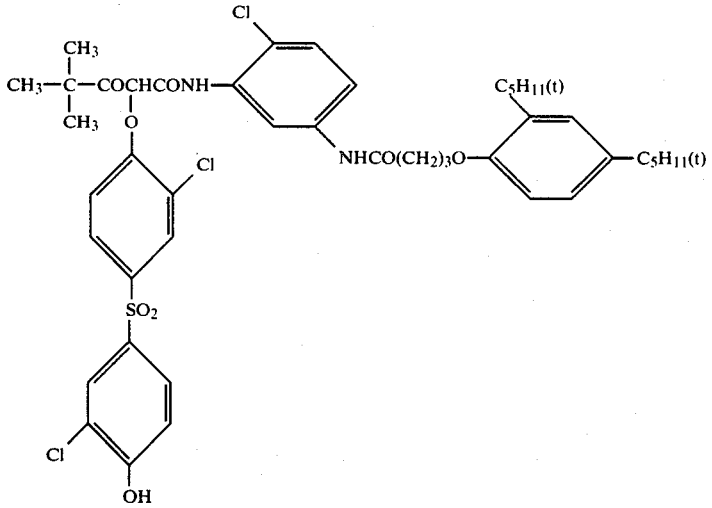
(Y-10)
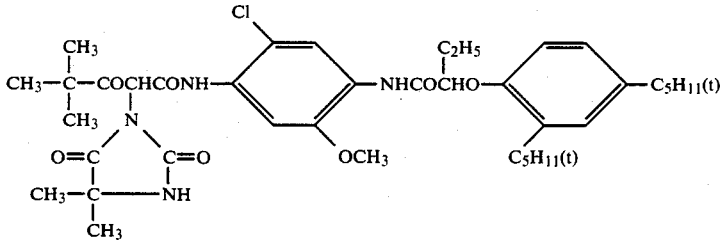
(Y-11)
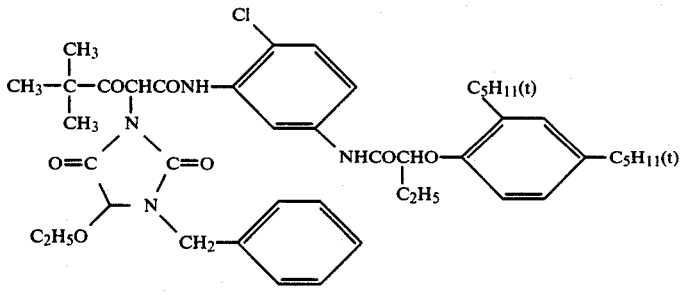
(Y-12)
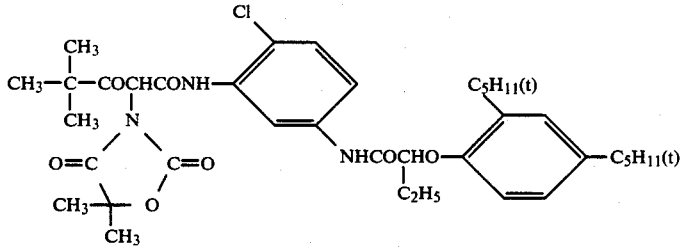

-continued
(Y-13)
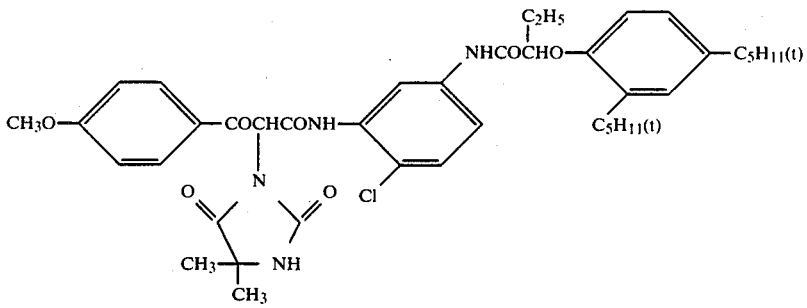
(Y-14)
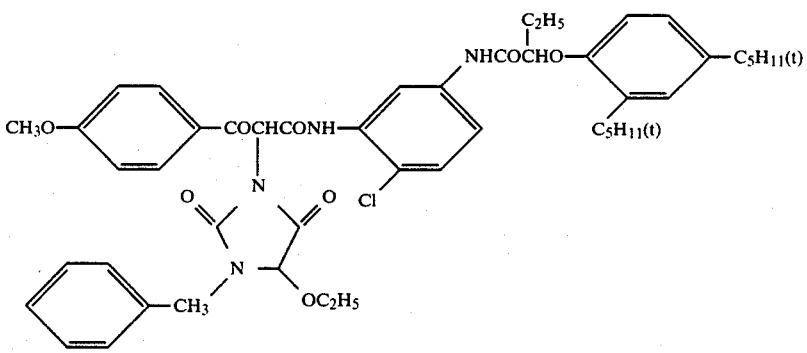
(Y-15)
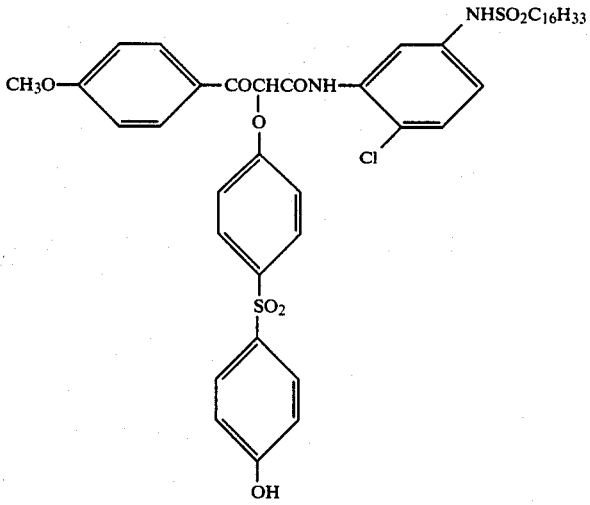
(Y-16)
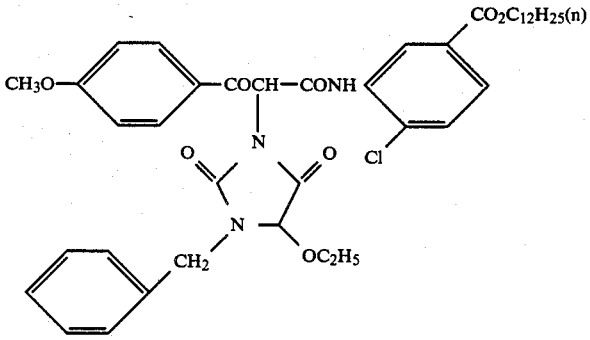
Of these yellow couplers, examples of combinations of Coupler (A) or Coupler (A') and Coupler (B) used together are illustrated below.
| Coupler (A) or Coupler (A') | Coupler (B) |
|---|---|
| Y-1 | Y-16 |
| Y-4 | Y-15 |

-continued

| Coupler (A) or Coupler (A') | Coupler (B) |
|---|---|
| Y-11 | Y-14 |
| Y-12 | Y-13 |

A magenta coupler which is incorporated into the green-sensitive silver halide emulsion layer unit is preferably selected from those represented by the following general formula (IV), (V), (VI), (VII), (VIII) or (IX).

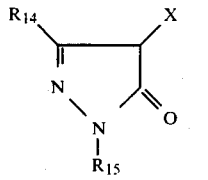
(IV)

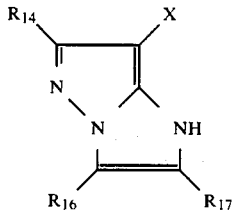
(V)

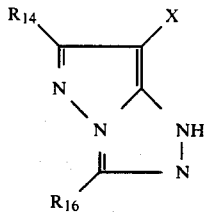
(VI)

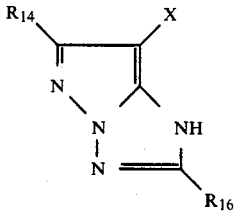
(VII)

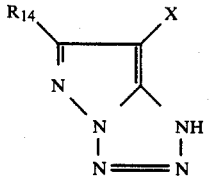
(VIII)

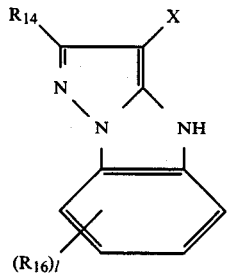
(IX)

In the above described general formula (IV), $R_{15}$ represents a straight chain or branched chain alkyl group having from 1 to 40 carbon atoms, preferably from 1 to 22 carbon atoms (e.g., a methyl group, an isopropyl group, a tert-butyl group, a hexyl group, a dodecyl group, etc.), an alkenyl group (e.g., an allyl group, etc.), a cyclic alkyl group (e.g., a cyclopentyl group, a cyclohexyl group, a norbornyl group, etc.), an aralkyl group (e.g., a benzyl group, a $\beta$-phenylethyl group, etc.), a cyclic alkenyl group (e.g., a cyclopentenyl group, a cyclohexenyl group, etc.), etc., each of which groups may be substituted with a halogen atom, a nitro group, a cyano group, an aryl group, an alkoxy group, an aryloxy group, a carboxy group, an alkylthiocarbonyl group, an arylthiocarbonyl group, an alkoxycarbonyl group, an aryloxycarbonyl group, a sulfo group, a sulfamoyl group, a carbamoyl group, an acylamino group, a diacylamino group, a ureido group, a urethane group, a thiourethane group, a sulfonamido group, a heterocyclic group, an arylsulfonyl group, an alkylsulfonyl group, an arylthio group, an alkylthio group, an alkylamino group, a dialkylamino group, an anilino group, an N-arylanilino group, an N-alkylanilino group, an N-acylanilino group, a hydroxy group, a mercapto group, etc.

$R_{15}$ may further represent an aryl group (e.g., a phenyl group, an $\alpha$- or $\beta$-naphthyl group, etc.). The aryl group may have one or more substituents. Specific examples of the substituents include an alkyl group, an alkenyl group, a cyclic alkyl group, an aralkyl group, a cyclic alkenyl group, a halogen atom, a nitro group, a cyano group, an aryl group, an alkoxy group, an aryloxy group, a carboxy group, an alkoxycarbonyl group, an aryloxycarbonyl group, a sulfo group, a sulfamoyl group, a carbamoyl group, an acylamino group, a diacylamino group, a ureido group, a urethane group, a sulfonamido group, a heterocyclic group, an arylsulfonyl group, an alkylsulfonyl group, an arylthio group, an alkylthio group, an alkylamino group, a dialkylamino group, an anilino group, an N-alkylanilino group, an N-arylanilino group, an N-acylanilino group, a hydroxy group, a mercapto group, etc. More preferable group for $R_{15}$ is a phenyl group which is substituted with an alkyl group, an alkoxy group, a halogen atom, etc., at at least one of the o-positions, because it is effective to restrain coloration of couplers remaining in film layers due to light or heat.

Furthermore, $R_{15}$ may represent a heterocyclic group (e.g., a 5-membered or 6-membered heterocyclic ring containing as a hetero atom a nitrogen atom, an oxygen atom or a sulfur atom, or a condensed ring thereof, with specific examples including a pyridyl group, a quinolyl group, a furyl group, a benzothiazolyl group, an oxazolyl group, an imidazolyl group, a naphthoxazolyl group, etc.), a group substituted with one or more substituents as defined for the above-described aryl group, an aliphatic acyl group, an aromatic acyl group, an alkylsulfonyl group, an arylsulfonyl group, an alkylcarbamoyl group, an arylcarbamoyl group, an alkylthiocarbamoyl group or an arylthiocarbamoyl group.

In the above described general formula (IV), (V), (VI), (VII), (VIII) or (IX), $R_{14}$ represents a hydrogen atom, a straight chain or branched chain alkyl group having from 1 to 40 carbon atoms, preferably from 1 to 22 carbon atoms, an alkenyl group, a cyclic alkyl group, an aralkyl group or a cyclic alkenyl group (each of which may have one or more substituents as defined for the above described substituent $R_{15}$), an aryl group or a heterocyclic group (each of which may also have one or more substituents as defined for the above described substituent $R_{15}$), an alkoxycarbonyl group (e.g., a methoxycarbonyl group, an ethoxycarbonyl group, a stearyloxycarbonyl group, etc.), an aryloxycarbonyl group (e.g., a phenoxycarbonyl group, a naphthoxycarbonyl group, etc.), an aralkyloxycarbonyl group (e.g., a benzyloxycarbonyl group, etc.), an alkoxy group (e.g., a methoxy group, an ethoxy group, a heptadecyloxy group, etc.), an aryloxy group (e.g., a phenoxy group, a tolyloxy group, etc.), an alkylthio group (e.g., an ethylthio group, a dodecylthio group, etc.), an arylthio group (e.g., a phenylthio group, an α-naphthylthio group, etc.), a carboxy group, an acylamino group (e.g., an acetylamino group, a 3-[(2,4-di-tert-amylphenoxy)acetamido]benzamido group, etc.), a diacylamino group, an N-alkylacylamino group (e.g., an N-methylpropionamido group, etc.), an N-arylacylamino group (e.g., an N-phenylacetamido group, etc.), a ureido group (e.g., a ureido group, an N-arylureido group, an N-alkylureido group, etc.), a urethane group, a thiourethane group, an arylamino group (e.g., a phenylamino group, an N-methylanilino group, a diphenylamino group, an N-acetylanilino group, a 2-chloro-5-tetradecanamidoanilino group, etc.), an alkylamino group (e.g., an n-butylamino group, a methylamino group, a cyclohexylamino group, etc.), a cycloamino group (e.g., a piperidino group, a pyrrolidino group, etc.), a heterocyclic amino group (e.g., a 4-pyridiylamino group, a 2-benzoxazolylamino group, etc.), an alkylcarbonyl group (e.g., a methylcarbonyl group, etc.), an arylcarbonyl group (e.g., a phenylcarbonyl group, etc.), a sulfonamido group (e.g., an alkylsulfonamido group, an arylsulfonamido group, etc.), a carbamoyl group (e.g., an ethylcarbamoyl group, a dimethylcarbamoyl group, an N-methylphenylcarbamoyl group, an N-phenylcarbamoyl group, etc.), a sulfamoyl group (e.g., an N-alkylsulfamoyl group, an N,N-dialkylsulfamoyl group, an N-arylsulfamoyl group, an N-alkyl-N-arylsulfamoyl group, an N,N-diarylsulfamoyl group, etc.), a cyano group, a hydroxy group, a mercapto group, a halogen atom or a sulfo group In the above described general formulae, $R_{16}$ and $R_{17}$ each represents a hydrogen atom, or a straight chain or branched chain alkyl group having from 1 to 32 carbon atoms, preferably from 1 to 22 carbon atoms, an alkenyl group, a cyclic alkyl group, an aralkyl group or a cyclic alkenyl group, each of which may have one or more substituents as defined for the above described substituent $R_{15}$.

Further, $R_{16}$ and $R_{17}$ may each represent an aryl group or a heterocyclic group, each of which may have one or more substituents as defined for the above described substituents $R_{15}$.

Furthermore, $R_{16}$ and $R_{17}$ may each represent a cyano group, an alkoxy group, an aryloxy group, a halogen atom, a carboxy group, an alkoxycarbonyl group, an aryloxycarbonyl group, an acyloxy group, a sulfo group, a sulfamoyl group, a carbamoyl group, an acylamino group, a diacylamino group, a ureido group, a urethane group, a sulfonamido group, an arylsulfonyl group, an alkylsulfonyl group, an arylthio group, an alkylthio group, an alkylamino group, a dialkylamino group, an anilino group, an N-arylanilino group, an N-alkylanilino group, an N-acylanilino group, a hydroxy group or a mercapto group.

In the above described general formula (IX), l represents an integer of 1 to 4, and when l represents an integer of 2 to 4, $R_{16}$'s may be the same or different.

In the above described general formulae (IV) to (IX), X has the same meaning as defined for the yellow coupler described above.

The substituent for $R_{14}$, $R_{15}$, $R_{16}$ or $R_{17}$ of the coupler represented by the above described general formula (IV), (V), (VI), (VII), (VIII), or (IX) may connect with each other or form a divalent group to form a polymer including a dimer or more. The polymer means a compound having two or more coupler skeletons in its molecule and includes a bis compound and a polymer coupler.

The polymer coupler may be a homopolymer consisting of a monomer unit having a coupler skeleton (preferably having a vinyl group) or a copolymer formed from a monomer unit having a coupler skeleton and at least one kind of a non-color-forming ethylenic monomer unit.

Of the magenta couplers represented by the above described general formula (IV), (V), (VI), (VII), (VIII) or (IX), Coupler (A) or Coupler (A') each forming a dye having the maximum adsorption in the wavelength range from 510 nm to 590 nm and Coupler (B) which forms a dye having the maximum adsorption wavelength at at least 5 nm longer than that of a dye formed from Coupler (A) or Coupler (A') in the case of using it together with Coupler (A) or Coupler (A') each particularly preferred are selected from those described below.

Coupler (A) or Coupler (A') is a coupler represented by the general formula (IV) described above wherein $R_{14}$ represents an alkylamino group, an arylamino group, a cycloamino group or a heterocyclic amino group or a coupler represented by the general formula (V) described above, and Coupler (B) is a coupler represented by the general formula (IV) described above wherein $R_{14}$ represents an acylamino group or a ureido group or a coupler represented by the general formula (VIII) described above.

Further, a coupler represented by the general formula (VI), (VII) or (IX) described above may function either as Coupler (A) or Coupler (A') or as Coupler (B) depending on the kind of substituents which are present thereon or the kind of oxidation product of an aromatic primary amine developing agent which undergoes the coupling reaction therewith. Therefore, the coupler may be used in combination with the above described Coupler (A) or (A') or Coupler (B). In addition, from couplers represented by the general formulae (VI), (VII) and (IX) described above, a coupler corresponding to Coupler (A) or (A') and a coupler corresponding to Coupler (B) may be selected.

Specific examples of particularly preferred compounds among magenta couplers used in the present invention are set forth below.

(M-1)
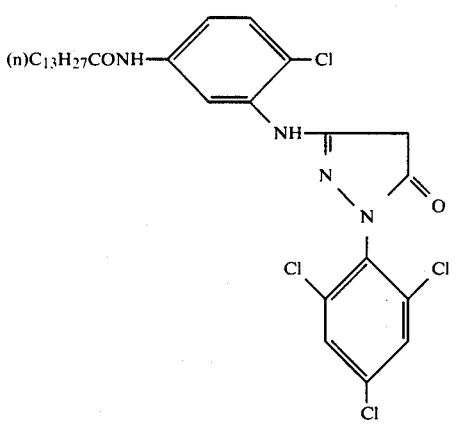
(M-2)
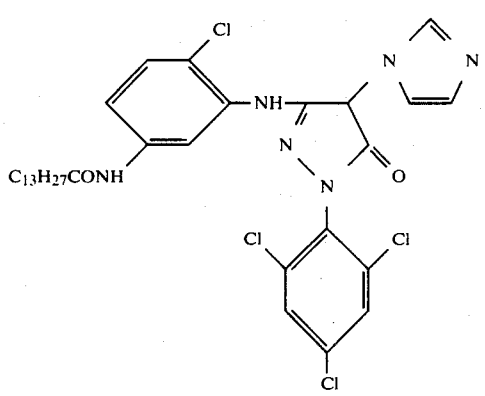
(M-3)
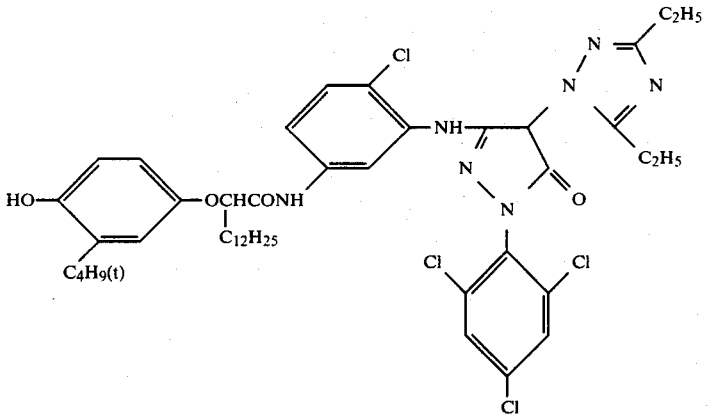
(M-4)
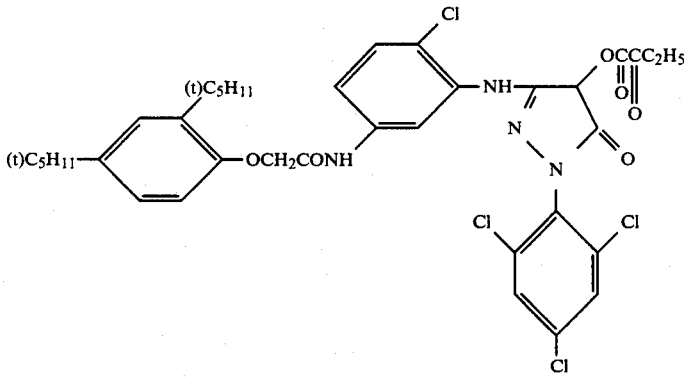
(M-5)
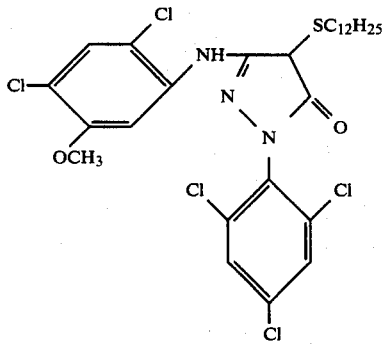

-continued
(M-6)
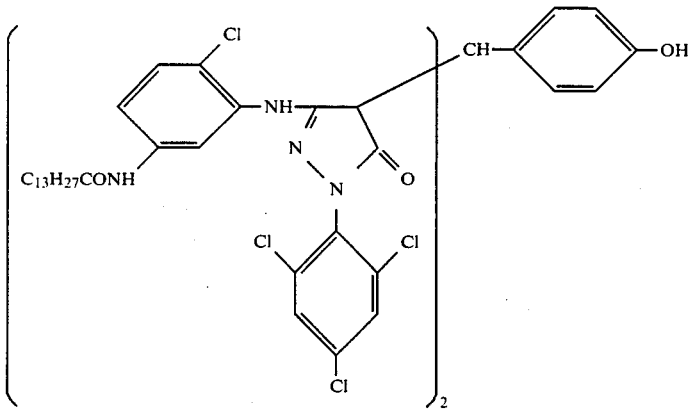
(M-7)
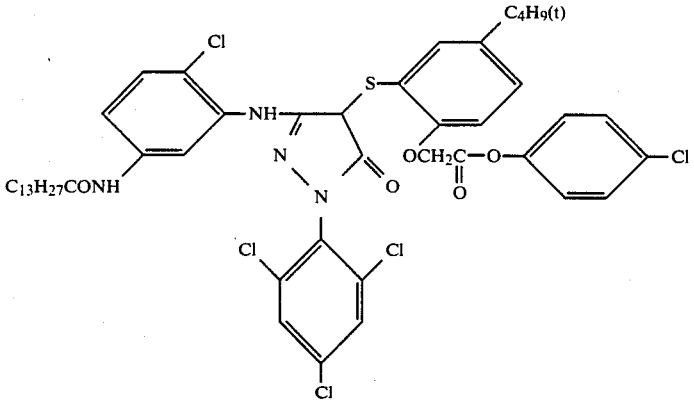
(M-8)
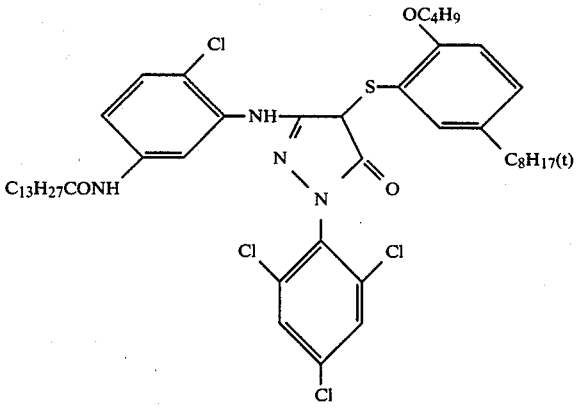
(M-9)
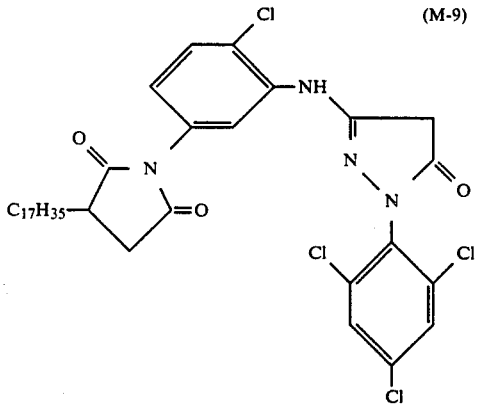
(M-10)
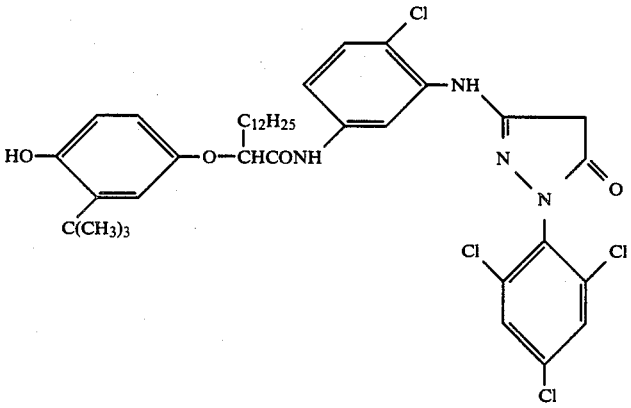

-continued
(M-11)
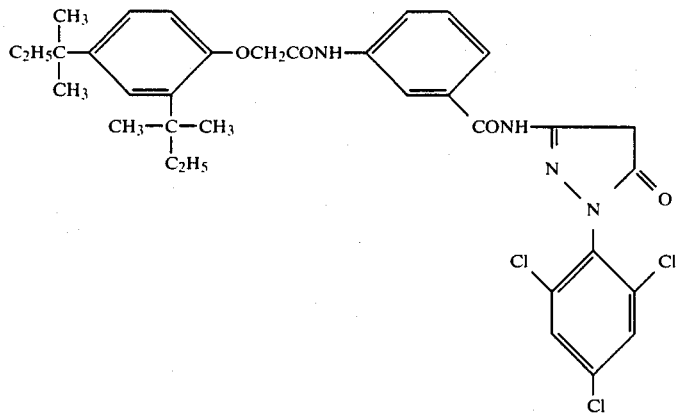
(M-12)
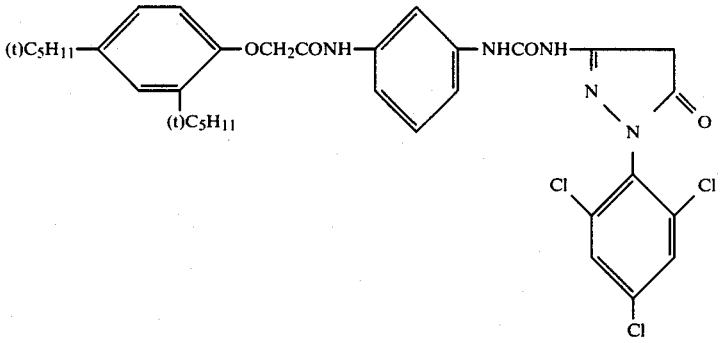
(M-13)
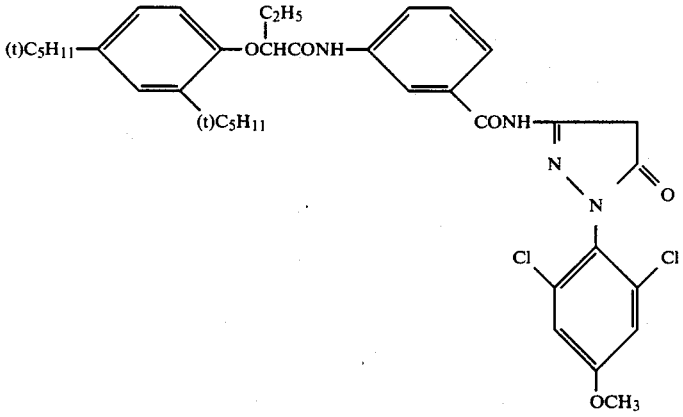
(M-14)
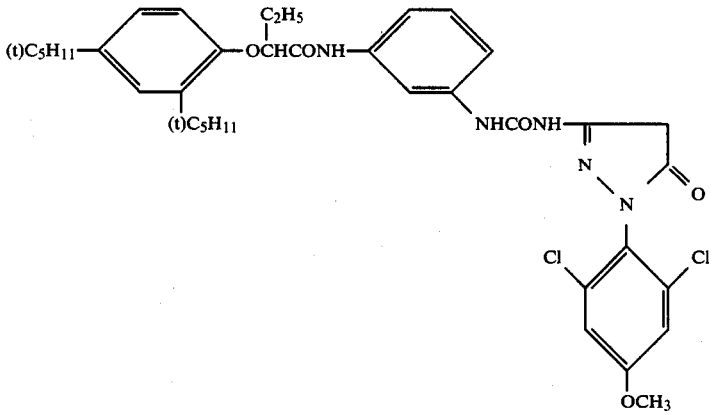

-continued
(M-15)
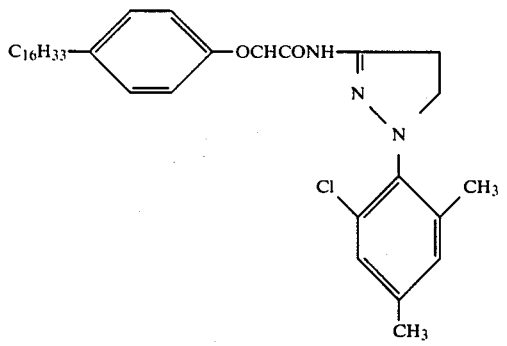
(M-16)
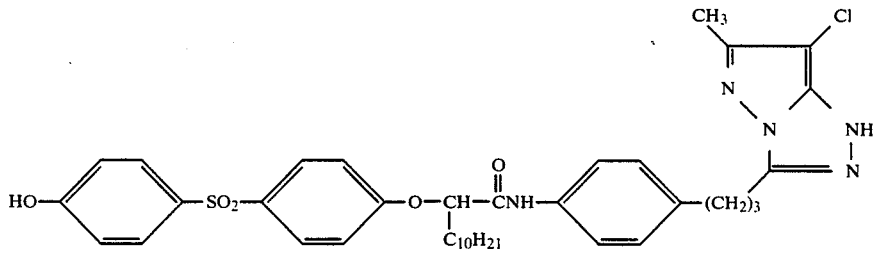
(M-17)
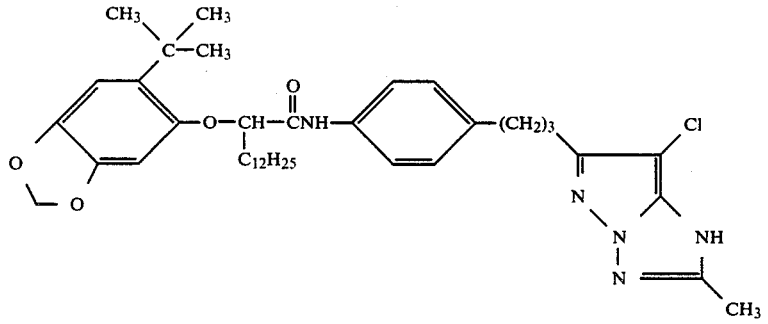
(M-18)
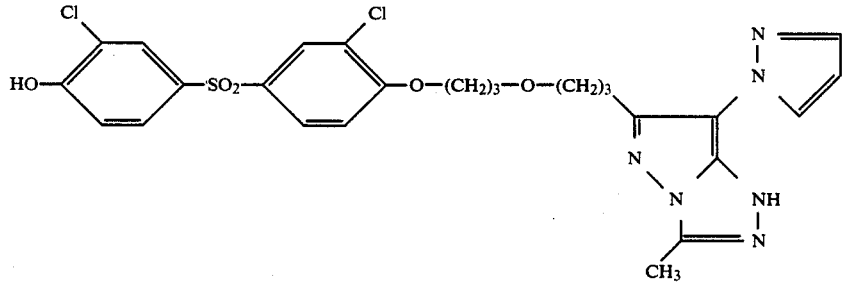
(M-19)
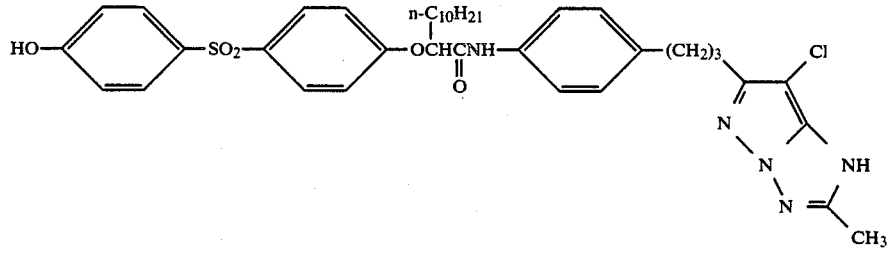

-continued (M-20)

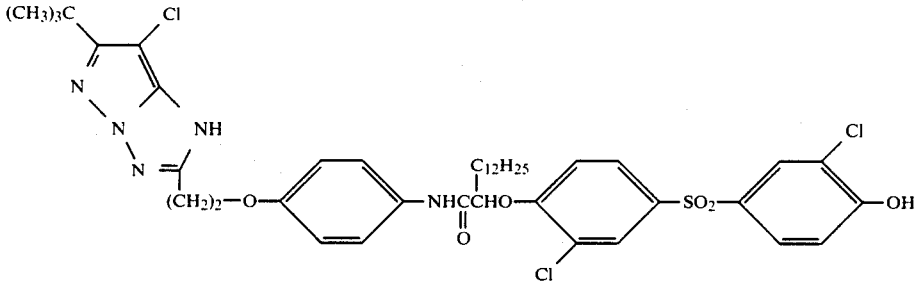

(M-21)

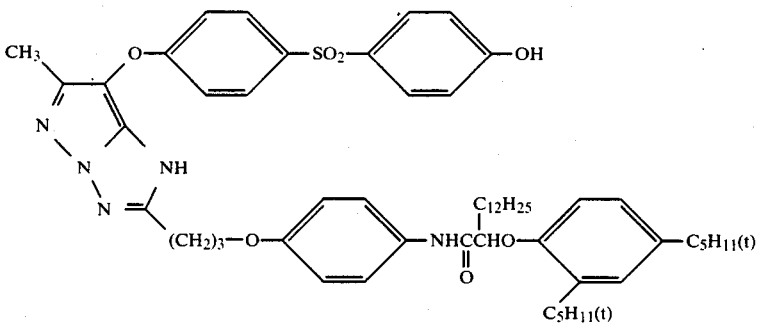

(M-22)

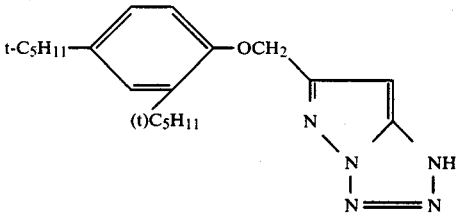

(M-23)

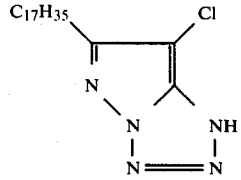

Of these magenta couplers, examples of combinations of Coupler (A) or (A') and Coupler (B) used togehter are illustrated below.

| Coupler (A) or Coupler (A') | Coupler (B) |
|---|---|
| M-1 | M-11 |
| M-1 | M-12 |
| M-1 | M-16 |
| M-9 | M-12 |
| M-8 | M-12 |
| M-8 | M-16 |
| M-8 | M-23 |

A cyan coupler which is incorporated into the red-sensitive silver halide emulsion layer unit is preferably selected from those represented by the following general formula (X), (XI) or (XII):

(X)

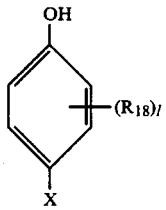

-continued (XI)

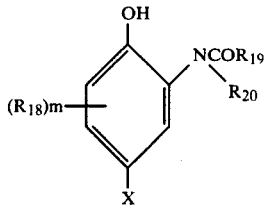

(XII)

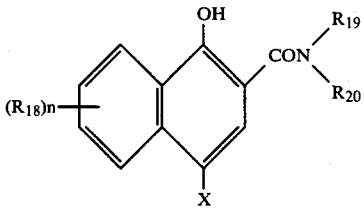

In the above described general formula (X), (XI) or (XII), $R_{18}$, $R_{19}$ and $R_{20}$ each represents a group which has been employed in conventional 4-equivalent type phenol or α-naphthol couplers. Specifically, $R_{18}$ represents a hydrogen atom, a halogen atom, an aliphatic hydrocarbon residue, an acylamino group, a ureido group, an —O—$R_{21}$ group or an —S—$R_{21}$ group (wherein $R_{21}$ is an aliphatic hydrocarbon residue). When two or more of $R_{18}$'s are present in one molecule, they may be different from each other. In the above described general formulae (X) and (XI), $R_{18}$ may form a saturated or unsaturated carbocyclic or heterocyclic ring which may be substituted with a substituent as described below with respect to the aliphatic hydrocarbon residues, aryl groups and heterocyclic groups. Specific examples of $R_{18}$ which forms such a ring include —$CH_2CH_2CH_2CH_2$—, —CH=CH—CH=CH—, —N=CH—CH=CH—, —NHCO—CH=CH—, —NHCO—$CH_2CH_2$—, —NHCO$CH_2$—, —NHCONH— and —NHCONH$CH_2$— wherein the hydrogen atom may be further substituted. The above described aliphatic hydrocarbon residues include those having substituents.

$R_{19}$ and $R_{20}$ each represents an aliphatic hydrocarbon residue, an aryl group or a heterocyclic group. Either of them may be a hydrogen atom. The above described groups for $R_{19}$ and $R_{20}$ may further have certain substituents. Furthermore, $R_{19}$ and $R_{20}$ may combine with each other and form a nitrogen-containing heterocyclic nucleus.

In the above described general formula (X), (XI) or (XII), l represents an integer of 1 to 4, m represents an integer of 1 to 3, and n represents an integer of 1 to 5.

More specifically, the above described aliphatic hydrocarbon residue includes both saturated and unsaturated ones, each of which may have a straight chain form, a branched chain form or a cyclic form. Preferred examples thereof include an alkyl group (e.g., a methyl group, an ethyl group, a propyl group, an isopropyl group, a butyl group, a tert-butyl group, an isobutyl group, a dodecyl group, an octadecyl group, a cyclobutyl group, a cyclohexyl group, etc.) and an alkenyl group (e.g., an allyl group, an octenyl group, etc.). The above described aryl group includes a phenyl group, a naphthyl group, etc. Representatives of the above described heterocyclic group include a pyridinyl group, a quinolyl group, a thienyl group, a piperidyl group, an imidazolyl group, etc. These aliphatic hydrocarbon residues, aryl groups and heterocyclic groups each may be substituted with a halogen atom, a nitro group, a hydroxy group, a carboxy group, an amino group, a substituted amino group, a sulfo group, an alkyl group, an alkenyl group, an aryl group, a heterocyclic group, an alkoxy group, an aryloxy group, an arylthio group, an arylazo group, an acylamio group, a carbamoyl group, an ester group, an acyl group, an acyloxy group, a sulfonamido group, a sulfamoyl group, a sulfonyl group, a morpholino group, etc.

Specific examples of the above described halogen atom include a fluorine atom, a chlorine atom and a bromine atom. Preferred acylamino groups can be represented by the following formula:

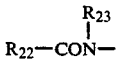

wherein $R_{22}$ represents substituted or unsubstituted alkyl groups, alkenyl groups, aryl groups or heterocyclic groups; $R_{23}$ represents a hydrogen atom or a substituted or unsubstituted alkyl group, the hydrogen atom being preferred.

Specific examples of the acylamino group include an acetylamino group, a butyrylamino group, a tetradecanoylamino group, a benzoylamino group, an o-chlorobenzoylamino group, a pentafluorobenzoylamino group, a 2-(2,4-di-tert-amylphenoxy)hexanoylamino group, a 2-(4-tert-amyl-2-chlorophenoxy)-tetradecanoylamino group and a 2-pyridylcarbonamido group. Preferred ureido groups can be represented by the following formula:

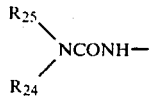

wherein $R_{24}$ and $R_{25}$ each represents a hydrogen atom, or the same substituent as $R_{22}$, with the proviso that $R_{24}$ and $R_{25}$ are not hydrogen atoms at the same time. Specific examples of the ureido group include a p-cyanophenylureido group, a 3,4-dichlorophenylureido group, a p-butanesulfonylureido group, an N',N'-dimethylureido group and a 2-thiazolylureido group.

In the above described general formula (X), (XI) or (XII), X has the same meaning as defined for the yellow coupler described above.

The substituent for $R_{18}$, $R_{19}$ or $R_{20}$ of the coupler represented by the general formula (X), (XI) or (XII) may connect with each other or form a divalent group to form a polymer including a dimer or more. The polymer means a compound having two or more coupler skeletons in its molecule and includes a bis compound and a polymer coupler.

The polymer coupler may be a homopolymer consisting of a monomer unit having a coupler skeleton (preferably having a vinyl group) or a copolymer formed from a monomer unit having a coupler skeleton and at least one kind of a non-color-forming ethylenic monomer unit.

Of the cyan couplers represented by the above described general formula (X), (XI) or (XII), Coupler (A) or Coupler (A') each forming a dye having the maximum absorption in the wavelength range from 600 nm to 700 nm and Coupler (B) which forms a dye having the maximum adsorption wavelength at at least 5 nm shorter than that of a dye formed from Coupler (A) or Coupler (A') in the case of using it together with Coupler (A) or Coupler (A') each particularly preferred are selected from those described below.

Coupler (A) or Coupler (A') is a coupler represented by the general formula (X) described above wherein an acylamino group or a ureido group is present at the 2-position and an alkyl group (particularly an alkyl group having at least two carbon atoms) is present at the 5-position, and more preferably, in addition, a halogen atom (particularly a chlorine atom) is present at the 6-position, and Coupler (B) is a coupler represented by the general formula (X) described above wherein an acylamino group or a ureido group is present at the 2-position and an acylamino group is present at the 5-position, and more preferably, in addition, a halogen atom (particularly a chlorine atom) is present at the 6-position or a coupler represented by the general formula (XII) described above wherein $R_{19}$ represents a hydrogen atom, $R_{20}$ represents an aliphatic group, an aryl group or a heterocyclic group, or $R_{19}$ and $R_{20}$ may combine with each other and forma a nitrogen-containing heterocyclic nucleus, and more preferably, in addition, $R_{18}$ represents a hydrogen atom.

Specific examples of particularly preferred compounds among the cyan couplers used in the present invention are set forth below.

(C-1)
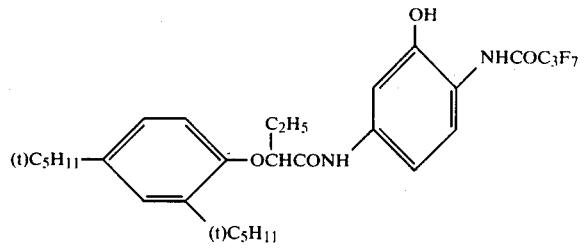
(C-2)
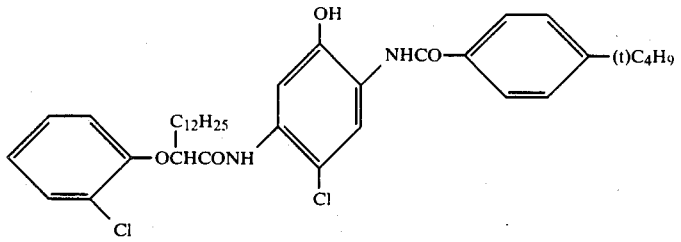
(C-3)
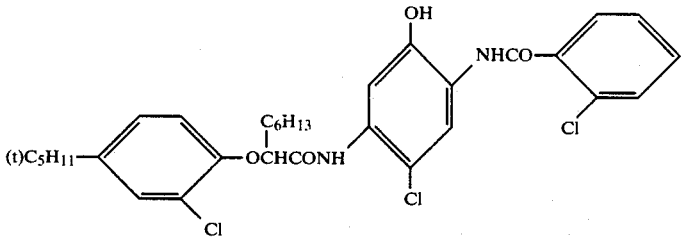
(C-4)
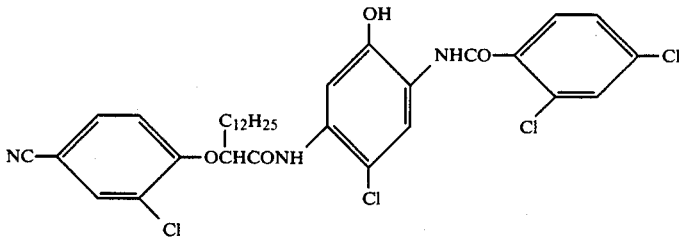
(C-5)
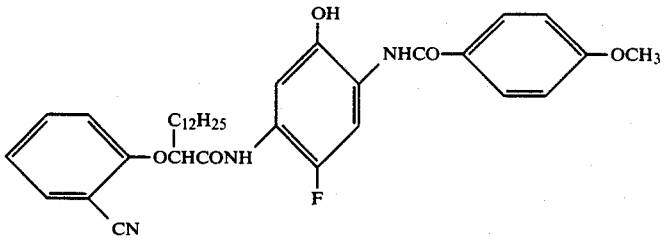
(C-6)
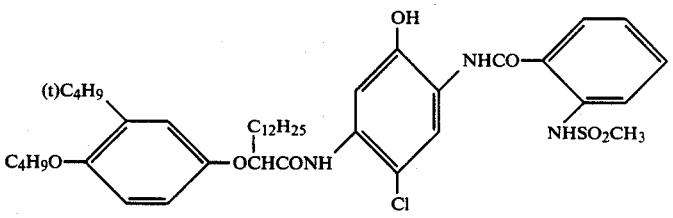

-continued
(C-7)
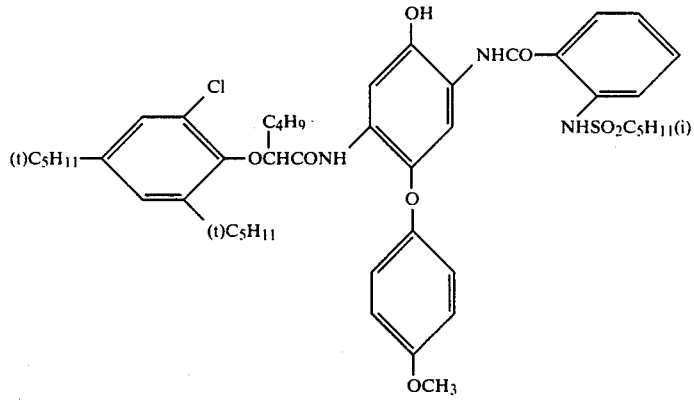
(C-8)
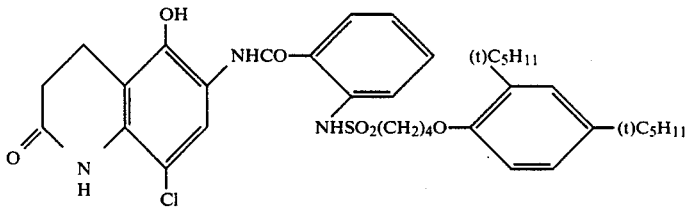
(C-9)
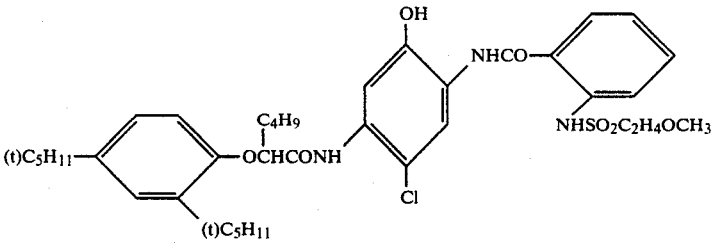
(C-10)
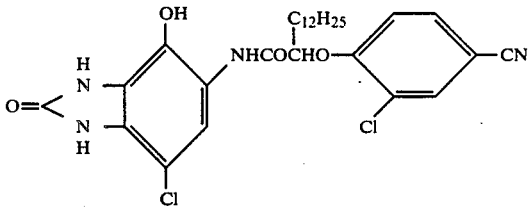
(C-11)
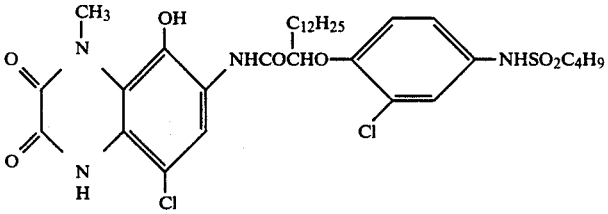
(C-12)
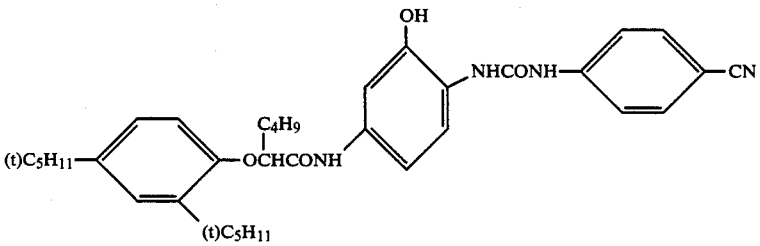

-continued
(C-13)
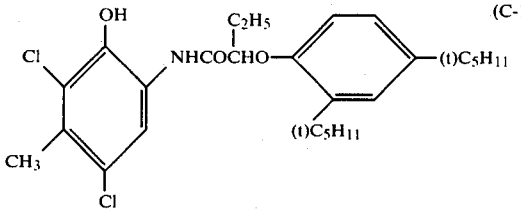
(C-14)
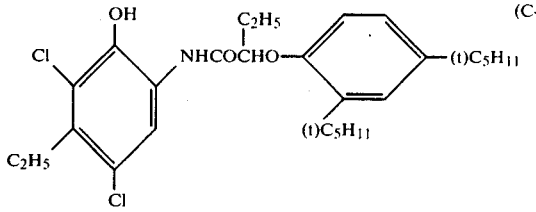
(C-15)
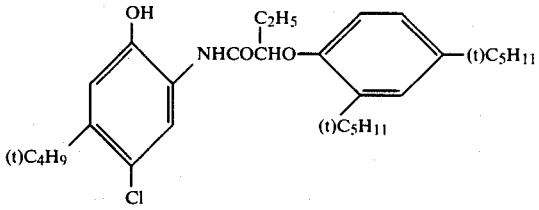
(C-16)
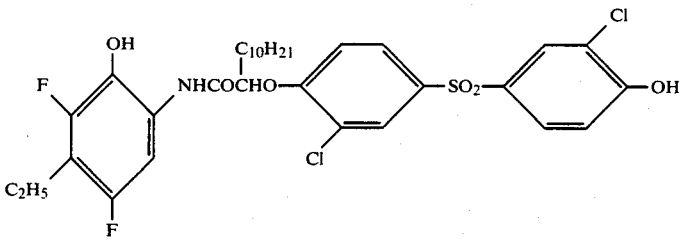
(C-17)
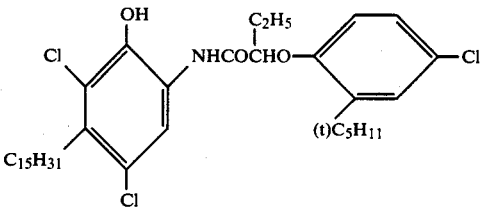
(C-18)
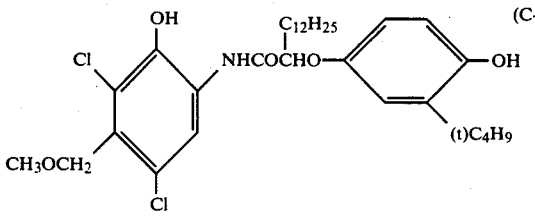
(C-19)
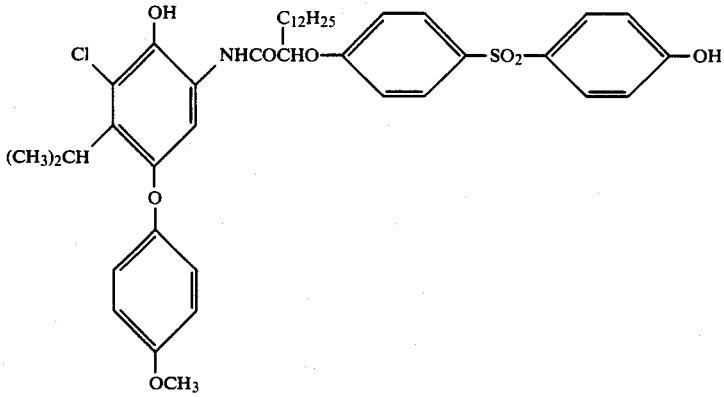
(C-20)
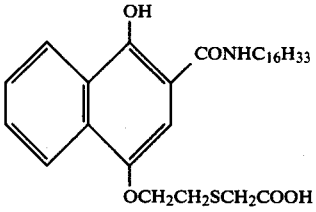
(C-21)
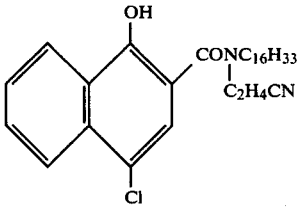

-continued

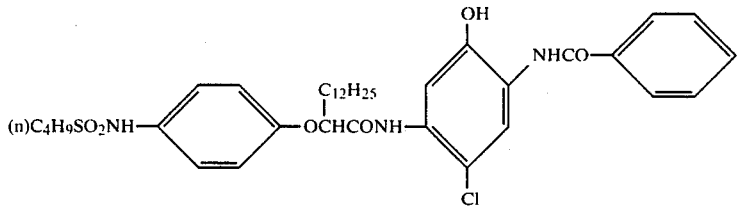

(C-22)

Of the cyan couplers, examples of combinations of Coupler (A) or (A') and Coupler (B) used together are illustrated below.

| Coupler (A) or Coupler (A') | Coupler (B) |
|---|---|
| C-13 | C-3 |
| C-13 | C-20 |
| C-14 | C-3 |
| C-14 | C-2 |
| C-15 | C-3 |

In order to incorporate the couplers according to the present invention into a silver halide emulsion layer, known methods including those as described, e.g., in U.S. Pat. No. 2,322,027 can be used. For example, they can be dissolved in a solvent and then dispersed in a hydrophilic colloid. Examples of solvents usable for this method include organic solvents having a high boiling point, such as alkyl esters of phthalic acid (e.g., dibutyl phthalate, dioctyl phthalate, etc.), phosphoric acid esters (e.g., diphenyl phosphate, triphenyl phosphate, tricresyl phosphate, dioctyl butyl phosphate, etc.), citric acid esters (e.g., tributyl acetyl citrate, etc.), benzoic acid esters (e.g., octyl benzoate, etc.), alkylamides (e.g., diethyl laurylamides, etc.), esters of fatty acids (e.g., dibutoxyethyl succinate, dioctyl azelate, etc.), trimesic acid esters (e.g., tributyl trimesate, etc.), or the like; and organic solvents having a boiling point of from about 30° to about 150° C., such as lower alkyl acetates (e.g., ethyl acetate, butyl acetate, etc.), ethyl propionate, secondary butyl alcohol, methyl isobutyl ketone, β-ethoxyethyl acetate, methyl cellosolve acetate, or the like. Mixtures of organic solvents having a high boiling point and organic solvents having a low boiling point can also be used.

It is also possible to utilize the dispersing method using polymers, as described in Japanese Patent Publication No. 39853/76 and Japanese Patent Application (OPI) No. 59943/76.

Of the couplers according to the present invention, those having an acid group, such as a carboxylic acid group or a sulfonic acid group, can be introduced into hydrophilic colloids as an aqueous alkaline solution.

As the binder or the protective colloid for the photographic emulsion layers or intermediate layers of the photographic material of the present invention, gelatin is advantageously used, but other hydrophilic colloids can be used alone or together with gelatin.

As gelatin used in the present invention, not only lime-processed gelatin, but also acid-processed gelatin may be employed. The methods for preparation of gelatin are described in greater detail in Arthur Veis, *The Macromolecular Chemistry of Gelatin,* Academic Press (1964).

In the photographic emulsion layer of the photographic material used in the present invention, any of silver bromide, silver iodobromide, silver iodochlorobromide, silver chlorobromide and silver chloride may be used as the silver halide. A preferred silver halide is silver iodobromide containing 15 mol% or less of silver iodide. A silver iodobromide emulsion containing from 2 mol% to 12 mol% of silver iodide is particularly preferred.

Although the mean grain size of silver halide grains in the photographic emulsion (the mean grain size being determined with a grain diameter in those grains which are spherical or nearly spherical, and an edge length in those grains which are cubic as a grain size, and is expressed as a mean value calculated from projected areas) is not particularly limited, it is preferably 3 μm or less.

The distribution of grain size may be broad or narrow.

Silver halide grains in the photographic emulsion may have a regular crystal structure, e.g., a cubic or octahedral structure, an irregular crystal structure, e.g., a spherical or plate-like structure, or a composite structure thereof. In addition, silver halide grains composed of those having different crystal structures may be used.

Further, the photographic emulsion wherein at least 50% of the total projected area of silver halide grains is super tabular silver halide grains having a diameter at least five times their thickness may be employed.

The present invention is also applicable to a multilayer multicolor photographic material containing layers sensitive to at least two different spectral wavelength ranges on a support. A multilayer multicolor photographic material generally possesses at least one red-sensitive silver halide emulsion layer, at least one green-sensitive silver halide emulsion layer and at least one blue-sensitive silver halide emulsion layer, respectively, on a support. The order of these layers can be varied, if desired. Ordinarily, a cyan forming coupler is present in a red-sensitive emulsion layer, a magenta forming coupler is present in a green-sensitive emulsion layer and a yellow forming coupler is present in a blue-sensitive emulsion layer, respectively. However, if desired, a different combination can be employed.

The same or different photographic emulsion layers or light-insensitive layers of the photographic material or the present invention can be incorporated, in addition to the couplers represented by the general formulae (I) to (XII) described above, with other dye forming couplers, i.e., compounds capable of forming color upon oxidative coupling with aromatic primary amine developing agents (e.g., phenylenediamine derivatives, aminophenol derivatives, etc.) during the course of color development processing.

Examples of such couplers include magenta couplers, such as 5-pyrazolone couplers, pyrazolobenzimidazole couplers, pyrazolotriazole couplers, pyrazoloimidazole couplers, pyrazolopyrazole couplers, pyrazolotetrazole couplers, cyanoacetylcoumarone couplers and open chain acylacetonitrile couplers, etc., yellow couplers, such as acylacetamide couplers (e.g., benzoyl acetanilides, pivaloylacetanilides, etc.) etc., and cyan couplers, such as naphthol couplers and phenol couplers, etc. It is preferable to use nondiffusible couplers containing a hydrophobic group (a so-called ballast group) within the molecules or polymeric couplers. They may be either 4-equivalent or 2-equivalent with respect to silver ions. It is also possible to use couplers capable of releasing development inhibitors during the course of development (so-called DIR couplers).

Further, the emulsion layer may contain noncolor-forming DIR coupling compounds which release a development inhibitor, the product of which formed by a coupling reaction is colorless, other than DIR couplers.

Moreover, the photographic material may contain compounds which release a development inhibitor during the course of development, other than DIR couplers.

Two or more kinds of the above described couplers and the like which may be employed together with the couplers according to the present invention can be incorporated together in the same layer for the purpose of satisfying the properties required of the photographic material, or the same compound can naturally be added to two or more layers.

A silver halide photographic emulsion which can be used in the present invention can be manufactured according to a method as disclosed in, for example, *Research Disclosure,* No. 17643 (December, 1978), pages 22–23 "I Emulsion preparation and types" and No. 18716 (November, 1979), page 648.

Various photographic addenda which can be used in the present invention are disclosed in, for example, ibid., No. 17643, pages 23–28 and No. 18716, pages 648 to 651 as illustrated below.

| Examples of Addenda | R.D. No. 17643 Page | R.D. No. 18716 Page |
|---|---|---|
| (1) Chemical sensitizers | 23 | 648 right col. |
| (2) Speed increasing compound | | " |
| (3) Spectral sensitizers and supersensitizers | 23 to 24 | 648 right col. to 649 right col. |
| (4) Antifoggants and stabilizers | 24 to 25 | 649 right col. |
| (5) Light-absorbing material, filter dyes, scattering materials and ultraviolet absorbers | 25 to 26 | 649 right col. to 650 left col. |
| (6) Antistain agents | 25 right col. | 650 left to right col. |
| (7) Hardeners | 26 | 651 left col. |
| (8) Vehicles and binding agents | 26 | 651 left col. |
| (9) Plasticizers and lubricants | 27 | 650 right col. |
| (10) Coating aids such as surfactants | 26 to 27 | " |
| (11) Agents for antistatic or conducting layers | 27 | " |

Suitable supports which can be used in the present invention are disclosed in, for example, ibid., No. 17643, page 28 and No. 18716, page 647 right column to page 648 left column.

A color photographic material according to the present invention can be processed by a conventional method as disclosed in, for example, ibid., No. 17643, pages 28 and 29 and No. 18716, page 651 left to right column.

In accordance with the present invention, a silver halide color photographic material which provides color images having improved color reproducibility in a wide range from low density areas to high density areas and high saturation is obtained by means of the constitution comprising three silver halide emulsion layer units sensitive to threee primary colors of blue, green and red, respectively, the layer unit being composed of plural layers having different sensitivities from each other and a layer thereof which is in charge of color formation of the highest density portion in the characteristic curve of these layers containing Coupler (E) which forms a dye having the maximum absorption wavelength different from a dye formed from Coupler (A) or (A') at least 5 nm in an amount of at least 30 mol% of the total amount of the couplers included therein.

Further, since in the present invention a degree of the coupling rate of the couplers used in the combinations of the couplers which satisfy the conditions of the maximum absorption wavelength according to the present invention is not necessary to consider, photographs having a stable finish which are not influenced by the conditions of development are obtained and, therefore, the present invention is excellent for practical use.

The present invention will be explained in greater detail with reference to the following examples, but the present invention should not be construed as being limited thereto.

Unless otherwise specified, all ratios, percents, etc., are by weight.

EXAMPLE 1

On a cellulose triacetate film were coated a first layer (undermost layer) to a third layer (uppermost layer) having the compositions described below to prepare a color photograhic material forming magenta color. This is designated Sample A.

| | |
|---|---|
| Third Layer: | Protective Layer<br>Gelatin (1,500 mg/m$^2$) |
| Second Layer: | High-Sensitive Green-Sensitive Layer<br>Silver iodobromide (containing 3.0 mol % of silver iodide) (1,000 mg/m$^2$)<br>Magenta Coupler (M-12) (300 mg/m$^2$)<br>Trihexyl phosphate (as coupler solvent) (1,800 mg/m$^2$) |
| First Layer: | Low-Sensitive Green-Sensitive Layer<br>Silver iodobromide (containing 3.0 mol % of silver iodide) (1,000 mg/m$^2$)<br>Magenta Coupler (M-1) (300 mg/m$^2$)<br>Trihexyl phosphate (as coupler solvent) (1,800 mg/m$^2$) |

Also, a sample was prepared in the same manner as described above except mixing the first layer and the second layer to form one layer, using the equimolar amount of the following magenta coupler:

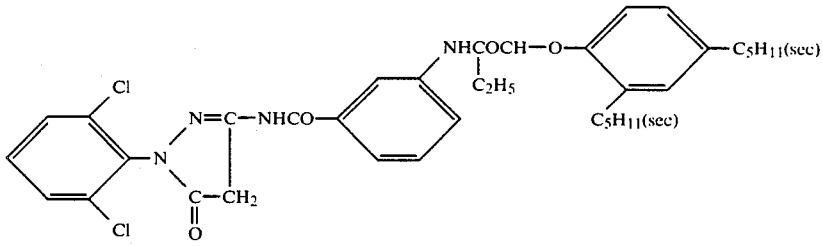

in place of Magenta Coupler (M-12) and using the equimolar amount of the following magenta coupler:

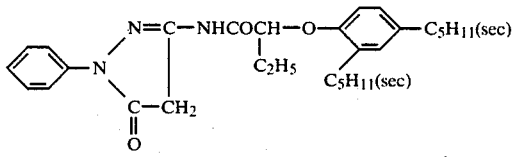

in place of Magenta Coupler (M-1). These magenta couplers used have different coupling rates from each other and are described in Japanese Patent Publication No. 43887/74. This sample designated Sample B.

These samples were exposed stepwise to light for sensitometry and subjected to the following development processing.

| Processing Steps | Temperature (°C.) | Time (min) |
|---|---|---|
| Color Development | 21 | 7 |
| Washing with Water | 21 | 1 |
| First Fixing | 21 | 4 |
| Washing with Water | 21 | 3 |
| Bleaching | 21 | 3 |
| Washing with Water | 21 | 2 |
| Second Fixing | 21 | 3 |
| Washing with Water | 18 | 20 |

The compositions of the processing solutions used for the above described processing steps were as follows:

| | |
|---|---|
| Color Developing Solution: | |
| Water | 1,000 ml |
| Benzyl Alcohol | 120 ml |
| Sodium Hexametaphosphate | 2.0 g |
| Sodium Sulfite (anhydrous) | 2.0 g |
| Sodium Carbonate (monohydrate) | 27.5 g |
| Hydroxylamine Sulfate | 2.5 g |
| 4-Amino-3-methyl-N—ethyl-N—(β-methanesulfonamido)aniline Sesquisulfate (monohydrate) | 4.0 g |
| Fixing Solution: (pH = 4.5) | |
| Water | 1,000 ml |
| Sodium Thiosulfate (hexahydrate) | 80 g |
| Sodium Sulfite (anhydrous) | 5 g |
| Borax | 6 g |
| Glacial Acetic Acid | 1 ml |
| Potassium Alum | 7 g |
| Bleaching Solution: (pH = 7.2) | |
| Water | 1,000 ml |
| Potassium Ferricyanide | 17 g |
| Boric Acid | 10 g |
| Borax | 5 g |
| Potassium Bromide | 7 g |

Samples A and B thus processed as described above were measured with reflective spectrum using a spectrophotometer and the maximum absorption wavelengths of the magenta images were determined.

Further, the maximum color densities (Dmax) of the magenta images of Samples A and B which were processed under the condition of restrained stirring of the solution at the time of color development were compared with the Dmax's obtained by processing with normal stirring and a degree of decrease in Dmax (ΔD) when processed under the restrained stirring condition was determined. These results thus obtained are shown in Table 1.

TABLE 1

Maximum Absorption Wavelength (nm) and Decrease in Dmax

| Sample | Maximum Absorbance of Color Image 0.5 | 1.0 | 1.5 | 2.0 | Decrease in Dmax Δ Dmax |
|---|---|---|---|---|---|
| A (Present Invention) | 536 | 537 | 539 | 541 | 0.08 |
| B (Comparison) | 539 | 540 | 541 | 543 | 0.36 |

From the results shown in Table 1 above, it is understood that with both the sample according to the present invention and the sample for comparison, the maximum absorption wavelength shifts to the longer wavelength side with an increase in color density, which wavelength shift is suitable for widening the color reproduction region of color films. However, although the sample according to the present invention provides a small change in Dmax due to the restrained stirring condition in the processing bath, with the sample for comparison a large change in Dmax due to the restrained stirring condition is observed, which large change in Dmax is not suitable for practical use.

EXAMPLE 2

On a paper support both surfaces of which were laminated with polyethylene were coated a first layer (undermost layer) to a sixth layer (uppermost layer) as shown below in order to prepare a multilayer color photographic material. This is designated Sample C. In the table below the coating amounts are set forth in mg/m$^2$.

| | |
|---|---|
| Sixth Layer: | Protective Layer |
| | Gelatin (1,500 mg/m$^2$) |
| Fifth Layer: | Red-Sensitive Layer |
| | Silver chlorobromide emulsion (silver bromide: 50 mol %, silver: 250 mg/m$^2$) |
| | Gelatin (1,500 mg/m$^2$) |
| | Cyan coupler*1 (500 mg/m$^2$) |
| | Coupler solvent*2 (250 mg/m$^2$) |
| Fourth Layer: | Ultraviolet Absorbing Layer |
| | Gelatin (1,200 mg/m$^2$) |
| | Ultraviolet absorbing agent*3 (700 mg/m$^2$) |
| | Ultraviolet absorbing agent solvent*2 |

-continued

| | |
|---|---|
| | (250 mg/m$^2$) |
| Third Layer: | Green-Sensitive Layer<br>Silver chlorobromide emulsion (silver bromide: 70 mol %, silver: 350 mg/m$^2$)<br>Gelatin (1,500 mg/m$^2$)<br>Magenta coupler*4 (400 mg/m$^2$)<br>Coupler solvent*5 (400 mg/m$^2$) |
| Second Layer: | Intermediate Layer<br>Gelatin (1,000 mg/m$^2$) |
| First Layer: | Blue-Sensitive Layer<br>Silver chlorobromide emulsion (silver bromide: 80 mol %, silver: 350 mg/m$^2$)<br>Gelatin (1,500 mg/m$^2$)<br>Yellow coupler*6 (500 mg/m$^2$)<br>Coupler solvent*2 (500 mg/m$^2$) |
| Support: | Paper support both surfaces of which were laminated with polyethylene [white pigment ($TiO_2$, etc.) and bluish dye (ultramarine blue, etc.) are incorporated into the polyethylene layer of the first layer side] |

*1Cyan Coupler (C-13): 2-[α-(2,4-Di-tert-amylphenoxy)butanamido]-4,6-dichloro-5-methylphenol
*2Coupler Solvent: Trinonyl phosphate
*3Ultraviolet Absorbing Agent: 2-(2-Hydroxy-3-sec-butyl-5-tert-butylphenyl)-benzotriazole
*4Magenta Coupler (M-1): 1-(2,4,6-Trichlorophenyl)-3-(2-chloro-5-tetradecanamido)anilino-2-pyrazolin-5-one
*5Coupler Solvent: o-Cresyl phosphate
*6Yellow Coupler (Y-12): o-Pivaloyl-o-(2,4-dioxo-5,5'-dimethyloxazolidin-3-yl)-2-chloro-5-[o-(2,4-di-tert-amylphenoxy)-butanamido]acetanilide The fifth layer of Sample C was divided into two layers each of which contains a half amount of gelatin and coupler respectively and which are different in sensitivity from each other by using silver halide emulsions having mean grain sizes different from each other. Further, 80 mol% of Cyan Coupler (C-13) (providing the maximum absorption wavelength of 658 nm) in the low-sensitive layer was substituted with Cyan Coupler (C-3) described above which forms a dye having the maximum absorption wavelength 20 nm shorter than that of (C-13) and the sensitivity and gradation were adjusted to those of Sample C whereby Sample D was prepared in the same manner as described for Sample C except tha above described points.

Further, in the same manner as described for Sample C except substituting 40 mol% of Cyan Coupler (C-13) in the fifth layer of Sample C with Cyan Coupler (C-3) described above Sample E was prepared.

Moreover, in the same manner as described for Sample C except substituting 40 mol% of Cyan Coupler (C-13) (having the relative coupling rate constant of 4.0) with Cyan Coupler E' illustrated below (having the maximum absorption wavelength of 658 nm and the relative coupling rate constant of 0.9) which is described in Japanese Patent Publication No. 43887/74. Sample F was prepared.

Cyan Coupler E'

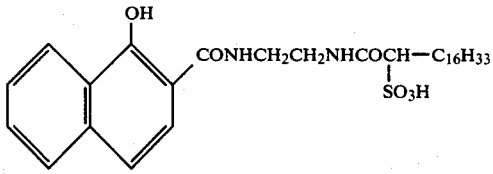

Samples C, D, E and F thus prepared were exposed to red light and subjected to the development processing described below. At the light exposure, amounts of the exposure were controlled so as to provide cyan densities of 0.5, 1.0, 1.5 and 2.0, respectively, which were measured using a densitometer (Fuji FSD-103).

| Processing Steps (at 33° C.) | Time |
|---|---|
| Color Development | 3 min 30 sec |
| Bleach-Fixing | 1 min 30 sec |
| Washing with Water | 3 min |
| Drying (at 50 to 80° C.) | 2 min |

The compositions of the processing solutions used for the above described processing steps were as follows:

| | |
|---|---|
| Color Developing Solution | |
| Benzyl Alcohol | 12 ml |
| Diethylene Glycol | 5 ml |
| Potassium Carbonate | 25 g |
| Sodium Chloride | 0.1 g |
| Sodium Bromide | 0.5 g |
| Anhydrous Sodium Sulfite | 2 g |
| Hydroxylamine Sulfate | 2 g |
| Fluorescent Whitening Agent | 1 g |
| N—Ethyl-N—β-methanesulfonamidoethyl-3-methyl-4-aminoaniline Sulfate | 4 g |
| Water to make | 1 l |
| Sodium hydroxide was added to adjust the pH to 10.2 | |
| Bleach-Fixing Solution | |
| Ammonium Thiosulfate | 124.5 g |
| Sodium Metabisulfite | 13.3 g |
| Anhydrous Sodium Sulfite | 2.7 g |
| Iron (III) Ammonium Ethylenediamine-tetraacetate | 65 g |
| Color Developing Solution (described above) | 100 ml |
| Water to make | 1 l |
| Adjustment of pH to 6.7 to 6.8 | |

The development processing was carried out using a conventional roller transportation type development machine and the processing solutions, the composition of which had become almost equilibrium condition by processing under the normal replenish procedure.

Samples C to F thus processed as described above were measured with reflective spectrum using a spectrophotometer and the maximum absorption wavelengths of the cyan images were determined.

Further, the maximum color densities (Dmax) of the cyan images of Samples C to F which were processed under the conditions of restrained stirring of solution at the time of color development were compared with the Dmax's obtained by processing with normal stirring and a degree of decrease in Dmax (ΔD) when processed under the restrained stirring condition was determined. These results thus obtained are shown in Table 2.

TABLE 2

Maximum Absorption Wavelength (nm) and Decrease in Dmax

| Sample | Cyan Density (FSD-103) 0.5 | 1.0 | 1.5 | 2.0 | Decrease in Dmax ΔDmax |
|---|---|---|---|---|---|
| C (Comparison) | 658 | 658 | 658 | 658 | 0.05 |
| D (Present Invention) | 658 | 657 | 653 | 648 | 0.05 |
| E (Comparison) | 654 | 654 | 654 | 654 | 0.05 |
| F (Comparison) | 658 | 656 | 652 | 648 | 0.28 |

From the results shown in Table 2 above, it is understood that the sample according to the present invention provides the cyan color images, the maximum absorption wavelength of which shifts to the shorter wavelength side with an increase in color density, which wavelength shift is suitable for widening the color reproduction region of color films. Further, the improvement in saturation is apparently observed by visual judgment.

On the contrary, while Sample F for comparison exhibits the preferred tendency that the maximum absorption wavelength shifts to the shorter wavelength side with an increase in color density, it provides a large change in Dmax due to the restrained stirring condition, which large change is not suitable for practical use.

EXAMPLE 3

On a paper support both surfaces of which were laminated with polyethylene were coated a first layer (undermost layer) to an eleventh layer (uppermost layer) as shown below in order to prepare a multilayer color photographic material. This is designated Sample G. In the table below the coating amounts are set forth in mg/m$^2$.

| | |
|---|---|
| Eleventh Layer: | Protective Layer<br>Gelatin (1,000 mg/m$^2$)<br>Silver chlorobromide emulsion (silver bromide: 2.0 mol %, mean grain size: 0.2 μm, silver: 10 mg/m$^2$) |
| Tenth Layer: | Ultraviolet Absorbing Layer<br>Gelatin (1,500 mg/m$^2$)<br>Ultraviolet absorbing agent*1 (1,000 mg/m$^2$)<br>Ultraviolet absorbing agent solvent*2 (300 mg/m$^2$)<br>Color stain preventing agent*3 (80 mg/m$^2$) |
| Ninth Layer: | High-Sensitive Blue-Sensitive Layer<br>Silver iodobromide emulsion (silver iodide: 2.5 mol %, mean grain size: 1.0 μm, silver: 200 mg/m$^2$)<br>Blue color sensitizing dye*4<br>Gelatin (1,000 mg/m$^2$)<br>Yellow coupler*5 (400 mg/m$^2$)<br>Coupler solvent*2 (100 mg/m$^2$) |
| Eighth Layer: | Low-Sensitive Blue-Sensitive Layer<br>Silver iodobromide emulsion (silver iodide: 2.5 mol %, mean grain size: 0.5 μm, silver: 150 mg/m$^2$)<br>Blue color sensitizing dye*4<br>Gelatin (500 mg/m$^2$)<br>Yellow coupler*5 (200 mg/m$^2$)<br>Coupler solvent*2 (50 mg/m$^2$) |
| Seventh Layer: | Yellow Filter Layer<br>Yellow colloidal silver (200 mg/m$^2$)<br>Gelatin (1,000 mg/m$^2$)<br>Color stain preventing agent*6 (60 mg/m$^2$)<br>Color stain preventing agent solvent*7 (240 mg/m$^2$) |
| Sixth Layer: | High-Sensitive Green-Sensitive Layer<br>Silver iodobromide emulsion (silver iodide: 3.5 mol %, mean grain size: 0.9 μm, silver: 200 mg/m$^2$)<br>Green color sensitizing dye*8<br>Gelatin (700 mg/m$^2$)<br>Magenta coupler*9 (150 mg/m$^2$)<br>Color fading preventing agent A*10 (50 mg/m$^2$)<br>Color fading preventing agent B*11 (50 mg/m$^2$)<br>Color fading preventing agent C*12 (20 mg/m$^2$)<br>Coupler solvent*13 (150 mg/m$^2$) |
| Fifth Layer: | Low-Sensitive Green-Sensitive Layer<br>Silver iodobromide emulsion (silver iodide: 2.5 mol %, mean grain size: 0.4 μm, silver: 200 mg/m$^2$)<br>Green color sensitizing dye, gelatin, magenta coupler, color fading preventing agents, coupler solvent being the same as described in the sixth layer. |
| Fourth Layer: | Intermediate Layer<br>Yellow colloidal silver (20 mg/m$^2$)<br>Gelatin (1,000 mg/m$^2$)<br>Color stain preventing agent*6 (80 mg/m$^2$)<br>Color stain preventing agent solvent*7 (160 mg/m$^2$)<br>Polymer latex*14 (400 mg/m$^2$) |
| Third Layer: | High-Sensitive Red-Sensitive Layer<br>Silver iodobromide emulsion (silver iodide: 8.0 mol %, mean grain size: 0.7 μm, silver: 100 mg/m$^2$)<br>Red color sensitizing dyes*15, *16<br>Gelatin (500 mg/m$^2$)<br>Cyan coupler*17 (100 mg/m$^2$)<br>Color fading preventing agent*18 (50 mg/m$^2$)<br>Coupler solvents*5, *19 (20 mg/m$^2$) |
| Second Layer: | Low-Sensitive Red-Sensitive Layer<br>Silver iodobromide emulsion (silver iodide: 3.5 mol %, mean grain size: 0.35 μm, silver: 150 mg/m$^2$)<br>Red color sensitizing dyes*15, *16<br>Gelatin (1,000 mg/m$^2$)<br>Cyan coupler*17 (300 mg/m$^2$)<br>Color fading preventing agent*18 (150 mg/m$^2$)<br>Coupler solvents*5, *19 (60 mg/m$^2$) |
| First Layer: | Antihalation Layer<br>Black colloidal silver (100 mg/m$^2$)<br>Gelatin (2,000 mg/m$^2$) |
| Support: | Paper support both surfaces of which were laminated with polyethylene (white pigment ($TiO_2$, etc.) and bluish dye (ultramarine blue, etc.) are incorporated into the polyethylene layer of the first layer side) |

*1 5-Chloro-2-(2-hydroxy-3-tert-butyl-5-tert-octyl-phenyl)benzotriazole
*2 Trinonyl phosphate
*3 2,5-Di-sec-octylhydroquinone
*4 Triethylamnonium 3-[2-(3-benzylrhodanin-5-ylidene)-3-benzoxazolinyl]propanesulfonate
*5 (Y-11):α-Pivaloyl-αα-(2,4-dioxo-1-benzyl-5-ethoxy-hydantoin-3-yl)-2-chloro-5-[α-2,4-di-tert-amyl-phenoxy)butanamido]acetanilide
*6 2,5-Di-tert-octylhydroquinone
*7 Tri-o-cresyl phosphate
*8 Sodium 5,5-diphenyl-9-ethyl-3,3'-disulfopropyl-oxacarbocyanine
*9 (M-1): 1-(2,4,6-Trichlorophenyl)-3-(2-chloro-5-tetradecanamido)anilino-2-pyrazolin-5-one
*10 3,3,3',3'-Tetramethyl-5,6,5',6'-tetrapropoxy-1,1'-bis-spiroindane
*11 Di(2-hydroxy-3-tert-butyl-5-methylphenyl)methane
*12 2,5-Di-tert-hexylhydroquinone
*13 Trioctyl phosphate
*14 Polyethyl acrylate
*15 Triethylammonium 3-[2-{2-[3-(3-sulfonatopropyl)-naphtho[1,2-α]thiazolin-2-ylidenemethyl]-1-butenyl}-3-naphtho[1,2-α]thiazolino]propanesulfonate
*16 Sodium 5,5'-dichloro-3,3'-di(3-sulfobutyl)-9-ethylthiacarbocyanine
*17 (C-13): 2-[α-(2,4-Di-tert-amylphenoxy)butanamido]-4,6-dichloro-5-methylphenol
*18 2-(2-Hydroxy-3-sec-butyl-5-tert-butylphenyl)-benzotriazole
*19 Dioctyl phthalate
*20 $[CH_2 = CHSO_2CHCONHCH_2]_2$ In the same manner as described for Sample G except substituting 150 mg/m$^2$ of 2-equivalent Magenta Coupler (M-16) described above for the total amount of Magenta Coupler (M-1) in the sixth layer and reducing a coating amount of silver to 60% of the sixth layer, substituting 150 mg/m$^2$ of 2-equivalent Magenta Coupler (M-8) described above for the total amount of Magenta Coupler (M-1) in the fifth layer and reducing a coating amount of silver to 60% of the fifth layer, substituting the equimolar amount of Cyan Coupler (C-3) described above for 80 mol% of Cyan Coupler (C-13) in the third layer, and adjusting the sensitivity and gradation to those of Sample G, Sample H was prepared. Samples A, B, C, D, E, F, G and H were each hardened by using a hardener as designated by *20.

Samples G and H thus prepared were exposed to red light and green light and subjected to the development processing described below. At the light exposure, amounts of the exposure were controlled so as to provide cyan densities and magenta densities of 0.5, 1.0, 1.5 and 2.0, respectively, which were measured using a densitometer (Fuji FSD-103).

| Processing Steps | Temperature (°C.) | Time (sec) |
|---|---|---|
| First Development (black-and-white development) | 38 | 75 |
| Washing with Water | 38 | 90 |
| Reversal Exposure: 100 lux | | |
| Color Development | 38 | 135 |
| Washing with Water | 38 | 45 |
| Bleach-Fixing | 38 | 120 |
| Washing with Water | 38 | 135 |
| Drying | 60 to 90 | until the samples are dried |

The compositions of the processing solutions used for the above described processing steps were as follows:

| | |
|---|---|
| First Developing Solution | |
| 6 Na Salt of Nitrilo-N,N,N—trimethylene-phosphonic Acid | 3.0 g |
| Anhydrous Potassium Sulfite | 20.0 g |
| Sodium Thiocyanate | 1.2 g |
| 1-Phenyl-4-methyl-4-hydroxymethyl-3-pyrazolidone | 2.0 g |
| Anhydrous Sodium Carbonate | 30.0 g |
| Potassium Hydroquinone Monosulfonate | 30.0 g |
| Potassium Bromide | 2.5 g |
| Potassium Iodide (0.1% aq. soln.) | 2 ml |
| Water to make | 1,000 ml |
| Adjustment of pH to 9.7 | |
| Color Developing Solution | |
| Benzyl Alcohol | 15.0 ml |
| Ethylene Glycol | 12.0 ml |
| 6 Na Salt of Nitrilo-N,N,N—trimethylene-phosphonic Acid | 3.0 g |
| Potassium Carbonate | 26.0 g |
| Sodium Sulfite | 2.0 g |
| 1,2-Di(2-hydroxyethyl)mercaptoethane | 0.6 g |
| Hydroxylamine Sulfate | 3.0 g |
| 3-Methyl-4-amino-N—ethyl-N—(β-methane-sulfonamidoethyl)aniline Sulfate | 5.0 g |
| Sodium Bromide | 0.5 g |
| Potassium Iodide (0.1% aq. soln.) | 0.5 ml |
| Water to make | 1,000 ml |
| Adjustment of pH to 10.5 | |
| Bleach-Fixing Solution | |
| Ammonium [Ethylenediaminetetraacetato Ferrate (III)] Dihydrate | 80.0 g |
| Sodium Metabisulfite | 15.0 g |
| Ammonium Thiosulfate (58% aq. soln.) | 126.6 ml |
| 2-Mercapto-1,3,5-triazole | 0.20 g |
| Water to make | 1,000 ml |
| Adjustment of pH to 6.5 | |

Samples G and H thus processed as described above were measured with reflective spectrum using a spectrophotometer and the maximum absorption wavelengths of the cyan images and magenta images were determined. The results thus obtained are shown in Table 3.

TABLE 3

| | Maximum Absorption Wavelength (nm) | | | | | | | |
|---|---|---|---|---|---|---|---|---|
| | Magenta Density (FSD-103) | | | | Cyan Density (FSD-103) | | | |
| Sample | 0.5 | 1.0 | 1.5 | 2.0 | 0.5 | 1.0 | 1.5 | 2.0 |
| G (Comparison) | 536 | 536 | 535 | 535 | 658 | 658 | 658 | 658 |
| H (Present Invention) | 535 | 536 | 538 | 540 | 658 | 656 | 651 | 645 |

From the results shown in Table 3 above, it is understood that the sample according to the present invention provides the cyan color images, the maximum absorption wavelength of which shifts to the shorter wavelength side with an increase in color density and the magenta color images, the maximum absorption wavelength of which shifts to the longer wavelength side with an increase in color density, which wavelength shifts are suitable for widening the color reproduction region.

Using the reflective spectra thus obtained, a color range in the (U,V) chromaticity diagram (UCS chromaticity diagram by D. L. MacAdam, as described, for example, in T. H. James, *The Theory of the Photographic Process,* Fourth Ed., page 564, Macmillan Co. (1977), etc.) was obtained. The results are illustrated in FIG. 1. It is apparent from FIG. 1 that Sample G according to the present invention exhibits a particularly wide color range in high density areas (visual transmittance T=10%) in comparison with Sample H for comparison. In addition, the improvement in saturation is clearly observed in practical prints.

EXAMPLE 4

On a cellulose triacetate film support were coated a first layer (undermost layer) to a twelfth layer (uppermost layer) as described below in order to prepare a color reversal photographic material. This is designated Sample I.

First Layer: Antihalation Layer

A gelatin layer containing black colloidal silver

Second Layer: Gelatin Intermediate Layer 0.04 g/m$^2$ of 2,5-di-tert-octylhydroquinone was dissolved in 100 ml of dibutyl phthalate and 100 ml of ethyl acetate and stirred at a high speed together with 1 kg of a 10% aqueous gelatin solution to prepare an emulsion. Then, 2 kg of the emulsion thus obtained was mixed with 1 kg of a fine grain emulsion which had not been chemically sensitized (grain size: 0.06 μm, 1 mol% silver iodobromide emulsion) and 1.5 kg of a 10% aqueous gelatin solution, and the resulting mixture was coated at a dry layer thickness of 2 μm (silver amount: 0.4 g/m$^2$).

Third Layer: Low-Sensitive Red-Sensitive Emulsion Layer 100 g of Cyan Coupler (C-1), i.e., 2-(heptafluorobutyramido)-5-[2'-(2'',4''-di-tert-amylphenoxy)-butyramido]phenol was dissolved in 100 ml of tricresyl phosphate and 100 ml of ethyl acetate and stirred at a high speed together with 1 kg of a 10% aqueous gelatin solution to prepare an emulsion. Then, 500 g of the emulsion thus obtained was mixed with 1 kg of a red-sensitive silver iodobromide emulsion (containing 70 g of silver and 60 g of gelatin, and having an iodide content of 6 mol%), and the resulting mixture was then coated at a dry layer thickness of 1 μm (silver amount: 0.5 g/m$^2$).

Fourth Layer: High-Sensitive Red-Sensitive Emulsion Layer 100 g of Cyan Coupler (C-1), i.e., 2-(heptafluorobutyramido)-5-[2'-(2'',4''-di-tert-amulphenoxy)-butyramido]phenol was dissolved in 100 ml of tricresyl phosphate and 100 ml of ethyl acetate and stirred at a high speed together with 1 kg of a 10% aqueous gelatin solution to prepare an emulsion. Then, 1,000 g of the emulsion thus obtained was mixed with 1 kg of a red-sensitive silver iodobromide emulsion (containing 70 g of silver and 60 g of gelatin, and having an iodide content of 6 mol%), and the resulting mixture was then coated at a dry layer thickness of 2.5 μm (silver amount: 0.8 g/m$^2$).

Fifth Layer: Intermediate Layer 0.04 g/m$^2$ of 2,5-di-tert-octylhydroquinone was dissolved in 100 ml of dibutyl phthalate and 100 ml of ethyl acetate and stirred at a high speed together with 1 kg of a 10% aqueous gelatin solution to prepare an emulsion. Then, 1 kg of the emulsion thus obtained was mixed with 1 kg of a 10% aqueous gelatin solution, and the resulting mixture was coated at a dry layer thickness of 1 μm.

Sixth Layer: Low-Sensitive Green-Sensitive Emulsion Layer

An emulsion was prepared in the same manner as described in the preparation of the emulsion for the third layer except that Magenta Coupler (M-11), i.e., 1-(2,4,6-trichlorophenyl)-3-[3-(2,4-di-tert-amylphenoxyacetamido)benzamido]-5-pyrazolone, was used in place of the cyan coupler. Then, 300 g of the emulsion thus obtained was mixed with 1 kg of a green-sensitive silver iodobromide emulsion (containing 70 g of silver and 60 g of gelatin and having an iodide content of 7 mol%), and the resulting mixture was coated at a dry layer thickness of 1.3 μm (silver amount: 1.1 g/m$^2$).

Seventh Layer: High-Sensitive Green-Sensitive Emulsion Layer

An emulsion was prepared in the same manner as described in the preparation of the emulsion for the third layer except that Magenta Coupler (M-11), i.e., 1-(2,4,6-trichlorophenyl)-3-[3-(2,4-di-tert-amylphenoxyacetamido)benzamido]-5-pyrazolone, was used in place of the cyan coupler. Then, 1,000 g of the emulsion thus obtained was mixed with 1 kg of a green-sensitive silver iodobromide emulsion (containing 70 g of silver and 60 g of gelatin and having an iodide content of 6 mol%), and the resulting mixture was coated at a dry layer thickness of 3.5 μm (silver amount: 1.1 g/m$^2$).

Eighth Layer: Yellow Filter Layer

An emulsion containing yellow colloidal silver was coated at a dry layer thickness of 1 μm.

Ninth Layer: Low-Sensitive Blue-Sensitive Emulsion Layer

An emulsion was prepared in the same manner as described in the preparation of the emulsion for the third layer except that Yellow Coupler (Y-11), i.e., α-pivaloyl-α-(1-benzyl-5-ethoxy-3-hydantoinyl)-2-chloro-5-dodecyloxycarbonylacetanilide, was used in place of the cyan coupler. Then, 1,000 g of the emulsion thus obtained was mixed with 1 kg of a blue-sensitive silver iodobromide emulsion (containing 70 g of silver and 60 g of gelatin and having an iodide content of 7 mol%) and the resulting mixture was coated at a dry layer thickness of 1.5 μm (silver amount: 0.4 g/m$^2$).

Tenth Layer: High-Sensitive Blue-Sensitive Emulsion Layer

An emulsion was prepared in the same manner as described in the preparation of the emulsion for the third layer except that Yellow Coupler (Y-11), i.e., α-pivaloyl-α-(1-benzyl-5-ethoxy-3-hydantoinyl)-2-chloro-5-dodecyloxycarbonylacetanilide, was used in place of the cyan coupler. Then, 1,000 g of the emulsion thus obtained was mixed with 1 kg of a blue-sensitive silver iodobromide emulsion (containing 70 g of silver and 60 g of gelatin and having an iodide content of 6 mol%), and the resulting mixture was coated at a dry layer thickness of 3 μm (silver amount: 0.8 g/m$^2$).

Eleventh Layer: Second Protective Layer 1 kg of the emulsion used in the preparation of the fifth layer was mixed with 1 kg of a 10% aqueous gelatin solution and coated at a dry layer thickness of 2 μm.

Twelfth Layer: First Protective Layer

A 10% aqueous gelatin solution containing a surface fogged fine grain emulsion (grain size: 0.06 μm, 1 mol% silver iodobromide emulsion) was coated so that the amount of silver coated was 0.1 g/m$^2$ and the dry layer thickness was 0.8 μm.

In the same manner as described for Sample I except substituting Cyan Coupler (C-22) described above which forms a dye having the maximum absorption wavelength 19 nm shorter than that from (C-1) for Cyan Coupler (C-1) in the fourth layer, substituting the equimolar amount of Magenta Coupler (M-23) described above which forms a dye having the maximum absorption wavelength 19 nm longer than that from (M-11) for 80 mol% of Magenta Coupler (M-11) in the seventh layer, and adjusting the sensitivity and gradation to those of Sample I, Sample J was prepared.

Samples I and J thus prepared were exposed to blue light and green light and blue light and red light, respectively, and subjected to the reversal development processing described below. At the light exposure, amounts of the expsure were controlled so as to provide magenta densities and cyan densities of 0.5, 1.0, 2.0 and 3.0, respectively, which were measured using a densitometer (Fuji FSD-103).

| Processing Steps | Time (min) | Temperature (°C.) |
|---|---|---|
| Standard Processing | | |
| First Development | 6 | 38 |
| Washing with Water | 2 | 38 |
| Reversal | 2 | 38 |
| Color Development | 6 | 38 |
| Control | 2 | 38 |
| Bleaching | 6 | 38 |
| Fixing | 4 | 38 |
| Washing with Water | 4 | 38 |
| Stabilizing | 1 | Normal temperature |
| Drying | Until the samples are dried | Normal temperature to 60° C. |
| Sensitized Processing | | |
| First Development | 10 | 38 |
| Washing with Water | 2 | 38 |
| Reversal | 2 | 38 |
| Control Development | 6 | 38 |
| Control | 2 | 38 |
| Bleaching | 6 | 38 |
| Fixing | 4 | 38 |
| Washing with Water | 4 | 38 |
| Stabilizing | 1 | Normal temperature |
| Drying | Until the samples are dried | Normal temperature to 60° C. |

The compositions of processing solutions used for the above described processing steps were as follows:

| | |
|---|---|
| **First Developing Solution** | |
| Water | 700 ml |
| Sodium Tetrapolyphosphate | 2 g |
| Sodium Sulfite | 20 g |
| Hydroquinone Monosulfonate | 30 g |
| Sodium Carbonate (monohydrate) | 30 g |
| 1-Phenyl-4-methyl-4-hydroxymethyl-3-pyrazolidone | 2 g |
| Potassium Bromide | 2.5 g |
| Potassium Thiocyanate | 1.2 g |
| Potassium Iodide (0.1% aq. soln.) | 2 ml |
| Water to make | 1,000 ml (pH 10.1) |
| **Reversal Solution** | |
| Water | 700 ml |
| 6 Na Salt of Nitrilo-N,N,N—trimethylene-phosphonic Acid | 3 g |
| Stannous Chloride (dihydrate) | 1 g |
| p-Aminophenol | 0.1 g |
| Sodium Hydroxide | 8 g |
| Glacial Acetic Acid | 15 ml |
| Water to make | 1,000 ml |
| **Color Developing Solution** | |
| Water | 700 ml |
| Sodium Tetrapolyphosphate | 2 g |
| Sodium Sulfite | 7 g |
| Sodium Tertiary Phosphate (12 hydrate) | 36 g |
| Potassium Bromide | 1 g |
| Potassium Iodide (0.1% aq. soln.) | 90 ml |
| Sodium Hydroxide | 3 g |
| Citrazinic Acid | 1.5 g |
| N—Ethyl-N—(β-methanesulfonamidoethyl)-3-methyl-4-aminoaniline Sulfate | 11 g |
| Ethylenediamine | 3 g |
| Water to make | 1,000 ml |
| **Control Solution** | |
| Water | 700 ml |
| Sodium Sulfite | 12 g |
| Sodium Ethylenediaminetetraacetate (dihydrate) | 8 g |
| Thioglycerol | 0.4 ml |
| Glacial Acetic Acid | 3 ml |
| Water to make | 1,000 ml |
| **Bleaching Solution** | |
| Water | 800 ml |
| Sodium Ethylenediaminetetraacetate (dihydrate) | 2.0 g |
| Iron (III) Ammonium Ethylenediamine-tetraacetate (dihydrate) | 120.0 g |
| Potassium Bromide | 100.0 g |
| Water to make | 1,000 ml |
| **Fixing Solution** | |
| Water | 800 ml |
| Ammonium Thiosulfate | 80.0 g |
| Sodium Sulfite | 5.0 g |
| Sodium Bisulfite | 5.0 g |
| Water to make | 1,000 ml |
| **Stabilizing Solution** | |
| Water | 800 ml |
| Formalin (37 wt %) | 5.0 ml |
| Fuji Driwel | 5.0 ml |
| Water to make | 1,000 ml |

Samples I and J thus processed as described above were measured with reflective spectrum using a spectrophotometer and the maximum absorption wavelengths of the cyan images and magenta images were determined. The results thus obtained are shown in Table 4.

TABLE 4

| | Maximum Absorption Wavelength (nm) | | | | | | | |
|---|---|---|---|---|---|---|---|---|
| | Magenta Density | | | | Cyan Density | | | |
| Sample | 0.5 | 1.0 | 2.0 | 3.0 | 0.5 | 1.0 | 2.0 | 3.0 |
| I (Comparison) | 550 | 551 | 550 | 552 | 662 | 662 | 663 | 662 |
| J (Present Invention) | 550 | 552 | 555 | 558 | 662 | 661 | 660 | 657 |

From the results shown in Table 4 above, it is understood that the sample according to the present invention provides the cyan color images, the maximum absorption wavelength of which shifts to the shorter wavelength side with an increase in color density and the magenta color images, the maximum absorption wavelength of which shifts to the longer wavelength side with an increase in color density, which wavelength shifts are suitable for widening the color reproduction region.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having thereon at least three silver halide emulsion layer units sensitive to three primary colors of blue, green and red light, respectively, at least one of the silver halide emulsion layer units having at least two layers which are different in sensitivity from each other and containing at least Coupler (A') described below and Coupler (B) described below and one of said layers is in charge of color formation of the highest density portion in the characteristic curve of these layers and contains Coupler (B) described below which forms a dye having the maximum absorption wavelength different from a dye formed from Coupler (A) described below in an amount of at least 30 mol% of the total amount of the couplers included therein, wherein each of Couplers (A), (A') and (B) form dyes upon oxidative coupling with an aromatic primary amine developing agent during color development processing, Coupler (A) being in at least one of the blue-, green- or red-sensitive silver halide emulsion layer units, and Coupler (A) denotes (i) a coupler which forms a dye having the maximum absorption in the wavelength range from 400 nm to less than (the maximum absorption wavelength of a dye formed from Coupler (A')+5) nm, when the coupler is employed in a blue-sensitive silver halide emulsion layer unit, (ii) a coupler which forms a dye having the maximum absorption in the wavelength range from 510 nm to less than (the maximum absorption wavelength of a dye formed from Coupler (A')+5) nm, when the coupler is employed in a green-sensitive silver halide emulsion layer unit, or (iii) a coupler which forms a dye having the maximum absorption in the wavelength range from more than (the maximum absorption wavelength of a dye formed from Coupler (A')−5) nm to 700 nm, when the coupler is employed in a red-sensitive silver halide emulsion layer unit; Coupler (A') denotes a coupler which is employed in the largest amount by mol among the couplers contained in one or more layers than the layer which is in charge of color formation of the highest density portion in a characteristic curve of the silver halide emulsion layer unit; Coupler (B) denotes a coupler which forms a dye having the maximum absorption in the wavelength range other than that of a dye formed from Coupler (A); and the above described Couplers (A), (A') and (B) are substantially colorless and the maximum absorption of the dyes formed therefrom are present in (i) the wavelength range from 400 nm to 480 nm when they are employed in the blue-sensitive silver halide emulsion layer unit, (ii) the wavelength range from 510 nm to 590 nm when they are employed in the green-sensitive silver halide emulsion layer unit, or (iii) the wavelength range from 600 nm to 700 nm when they are employed in the red-sensitive silver halide emulsion layer unit, wherein Coupler (B) is a coupler which forms a dye, the maximum absorption wavelength thereof is present (i) in the wavelength range from (the maximum absorption wavelength of a dye formed from Coupler (A')+5) nm to 480 nm, when the coupler is employed in a blue-sensitive silver halide emulsion layer unit, (ii) in the wavelength range from (the maximum absorption wavelength of a dye formed from Coupler (A')+5) nm to 590 nm, when the coupler is employed in a green-sensitive silver halide emulsion layer unit or (iii) in the wavelength range from 600 nm to (the maximum absorption wavelength of a dye formed from Coupler (A')−5) nm, when the coupler is employed in a red-sensitive silver halide emulsion layer unit.

2. A silver halide color photographic material as claimed in claim 1, wherein a difference of the maximum absorption wavelengths of the dyes formed from Coupler (A') and Coupler (B) is from 5 nm to 40 nm.

3. A silver halide color photographic material as claimed in claim 1, wherein an amount of Coupler (B) added to the layer which is in charge of color formation of the highest density portion in the characteristic curve is from 30 mol% to 100 mol% based on the total amount of the couplers included in the layer.

4. A silver halide color photographic material as claimed in claim 1, wherein Coupler (A) and in addition Coupler (B) are incorporated into a low-sensitive layer which is in charge of color formation of the highest density portion in the characteristic curve and only Coupler (A') is incorporated into other layers of the silver halide emulsion layer unit.

5. A silver halide color photographic material as claimed in claim 1, wherein Coupler (A) and in addition Coupler (B) are incorporated into a high-sensitive layer which is in charge of color formation of the highest density portion in the characteristic curve and only Coupler (A') is incorporated into other layers of the silver halide emulsion layer unit.

6. A silver halide color photographic material as claimed in claim 1, wherein a coupler employed in the blue-sensitive silver halide emulsion layer unit is a yellow coupler represented by the following general formula (I), (II) or (III):

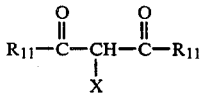

(I)

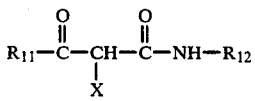

(II)

-continued

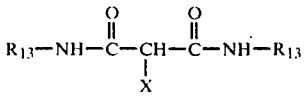

(III)

wherein $R_{11}$ represents an aliphatic group, an aromatic group, an alkoxy group or a heterocyclic group; $R_{12}$ and $R_{13}$ each represents an aromatic group or a heterocyclic group; and X represents a hydrogen atom or a group capable of being released upon the coupling reaction with an oxidation product of an aromatic primary amine developing agent.

7. A silver halide color photographic material as claimed in claim 6, wherein the aliphatic group represented by $R_{11}$ is an aliphatic group which may be substituted with a substituent selected from the group consisting of an alkoxy group, an aryloxy group, an amino group, an acylamino group and a halogen atom.

8. A silver halide color photographic material as claimed in claim 6, wherein the aromatic group represented by $R_{11}$, $R_{12}$ or $R_{13}$ is a phenyl group which may be substituted with a substituent selected from the group consisting of an alkyl group, an alkenyl group, an alkoxy group, an alkoxycarbonyl group, an alkoxycarbonylamino group, an aliphatic amido group, an alkylsulfamoyl group, an alkylsulfonamido group, an alkylureido group, an alkyl-substituted succinimido group each containing 32 or less carbon atoms, an aryloxy group, an aryloxycarbonyl group, an arylcarbamoyl group, an arylamido group, an arylsulfamoyl group, an arylsulfonamido group, an arylureido group, an amino group, a hydroxy group, a carboxy group, a sulfo group, a nitro group, a cyano group, a thiocyano group and a halogen atom.

9. A silver halide color photographic material as claimed in claim 6, wherein the aromatic group represented by $R_{11}$, $R_{12}$ or $R_{13}$ is a naphthyl group, a quinolyl group, an isoquinolyl group, a chromanyl group, a coumaranyl group or a tetrahydronaphthyl group.

10. A silver halide color photographic material as claimed in claim 6, wherein the alkoxy group represented by $R_{11}$ is an alkoxy group in which the alkyl moiety represents a straight chain or branched chain alkyl group having from 1 to 40 carbon atoms, an alkenyl group, a cyclic alkyl group or a cyclic alkenyl group each of which may be substituted with a substituent selected from the group consisting of a halogen atom, an aryl group and an alkoxy group.

11. A silver halide color photographic material as claimed in claim 6, wherein the heterocyclic group represented by $R_{11}$, $R_{12}$ or $R_{13}$ is a group derived from a hetero ring selected from the group consisting of thiophene, furan, pyran, pyrrole, pyrazole, pyridine, pyrazine, pyrimidine, pyridazine, indolizine, imidazole, thiazole, oxazole, triazine, thiadiazine and oxazine.

12. A silver halide color photographic material as claimed in claim 6, wherein the leaving group represented by X is a group connecting an aliphatic group, an aromatic group, a heterocyclic group, an aliphatic, aromatic or heterocyclic sulfonyl group or an aliphatic, aromatic or heterocyclic carbonyl group with the coupling active carbon atom through an oxygen atom, a nitrogen atom, a sulfur atom or a carbon atom, a halogen atom or an aromatic azo group.

13. A silver halide color photographic material as claimed in claim 6, wherein the leaving group represented by X is a halogen atom, an alkoxy group, an aryloxy group, an acyloxy group, an aliphatic or aromatic sulfonyloxy group, an acylamino group, an aliphatic or aromatic sulfonamido group, an alkoxycarbonyloxy group, an aryloxycarbonyloxy group, an aliphatic, aromatic or heterocyclic thio group, a carbamoylamino group, a 5-membered or 6-membered nitrogen-containing heterocyclic group or an imido group.

14. A silver halide color photographic material as claimed in claim 6, wherein the leaving group represented by X is a hydrogen atom, a halogen atom, an acylamino group, an imido group, an aliphatic or aromatic sulfonamido group, a 5-membered or 6-membered nitrogen-containing heterocyclic group connecting to the coupling active position through the nitrogen atom thereof, an aryloxy group or an alkoxy group.

15. A silver halide color photographic material as claimed in claim 6, wherein Coupler (A') is a coupler represented by the general formula (I) or (II) in claim 6, wherein $R_{11}$ represents an aliphatic group or an alkoxy group, and Coupler (B) is a coupler represented by the general formula (I) in claim 6 wherein one of $R_{11}$ represents an aliphatic group or an alkoxy group and the other of $R_{11}$ represents an aromatic group or a heterocyclic group or a coupler represented by the general formula (III) in claim 6.

16. A silver halide color photographic material as claimed in claim 1, wherein a coupler employed in the green-sensitive silver halide emulsion layer unit is a magenta coupler represented by the following general formula (IV), (V), (VI), (VII), (VIII) or (IX):

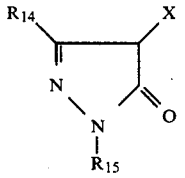
(IV)

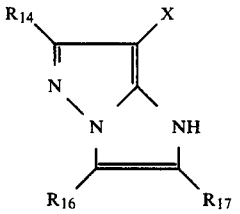
(V)

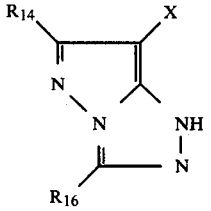
(VI)

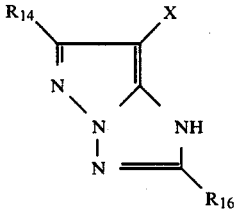
(VII)

-continued

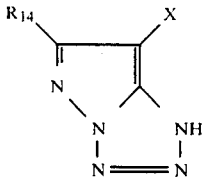
(VIII)

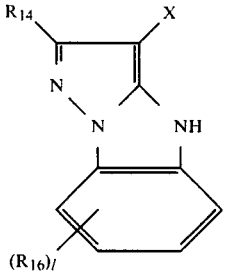
(IX)

wherein $R_{15}$ represents a straight chain or branched chain alkyl group having from 1 to 40 carbon atoms, an alkenyl group, a cyclic alkyl group, an aralkyl group or a cyclic alkenyl group each of which may be substituted with a substituent selected from a halogen atom, a nitro group, a cyano group, an aryl group, an alkoxy group, an aryloxy group, a carboxy group, an alkylthiocarbonyl group, an arylthiocarbonyl group, an alkoxycarbonyl group, an aryloxycarbonyl group, a sulfo group, a sulfamoyl group, a carbamoyl group, an acylamino group, a diacylamino group, a ureido group, a urethane group, a thiourethane group, a sulfonamido group, a heterocyclic group, an arylsulfonyl group, an alkylsulfonyl group, an arylthio group, an alkylthio group, an alkylamino group, a dialkylamino group, an anilino group, an N-arylanilino group, an N-alkylanilino group, an N-acylanilino group, a hydroxy group and a mercapto group; an aryl group which may be substituted with a substituent selected from the group consisting of an alkyl group, an alkenyl group, a cyclic alkyl group, an aralkyl group, a cyclic alkenyl group, a halogen atom, a nitro group, a cyano group, an aryl group, an alkoxy group, an aryloxy group, a carboxy group, an alkoxycarbonyl group, an aryloxycarbonyl group, a sulfo group, a sulfamoyl group, a carbamoyl group, an acylamino group, a diacylamino group, a ureido group, a urethane group, a sulfonamido group, a heterocyclic group, an arylsulfonyl group, an alkylsulfonyl group, an arylthio group, an alkylthio group, an alkylamino group, a dialkylamino group, an anilino group, an N-alkylanilino group, an N-arylanilino group, an N-acylanilino group, a hydroxy group and a mercapto group; a heterocyclic group which may be substituted with a substituent selected from the substituents as defined for the above described aryl group; an aliphatic acyl group; an aromatic acyl group, alkylsulfonyl group; an arylsulfonyl group; an alkylcarbamoyl group; an arylcarbamoyl group; an alkylthiocarbamoyl group; or an arylthiocarbamoyl group; $R_{14}$ represents a hydrogen atom; a straight chain or branched chain alkyl group having from 1 to 40 carbon atoms; an alkenyl group; a cyclic alkyl group; an aralkyl group; a cyclic alkenyl group; an aryl group or a heterocyclic group each of which may be substituted with a substituent selected from the substituents as defined for these groups of $R_{15}$ respectively; an alkoxycarbonyl group; an aryloxycarbonyl group; an aralkyloxycarbonyl group;

an alkoxy group; an aryloxy group; an alkylthio group; an arylthio group; a carboxy group; an acylamino group; a diacylamino group; an N-alkylacylamino group; an N-arylacylamino group; a ureido group; a urethane group; a thiourethane group; an arylamino group; an alkylamino group; a cycloamino group; a heterocyclic amino group; an alkylcarbonyl group; an arylcarbonyl group; a sulfonamido group; a carbamoyl group; a sulfamoyl group; a cyano group; a hydroxy group; a mercapto group; a halogen atom; or a sulfo group; $R_{16}$ and $R_{17}$ each represents a hydrogen atom; a straight chain or branched chain alkyl group having from 1 to 32 carbon atoms; an alkenyl group; a cyclic alkyl group; an aralkyl group; a cyclic alkenyl group; an aryl group or a heterocyclic group each of which may be substituted with a substituent selected from the substituents as defined for these groups of $R_{15}$ respectively; a cyano group; an alkoxy group; an aryloxy group; a halogen atom; a carboxy group; an alkoxycarbonyl group; an aryloxycarbonyl group; an acyloxy group; a sulfo group; a sulfamoyl group; a carbamoyl group; an acylamino group; a diacylamino group; a ureido group; a urethane group; a sulfonamido group; an arylsulfonyl group; an alkylsulfonyl group; an arylthio group; an alkylthio group; an alkylamino group; a dialkylamino group; an anilino group; an N-arylanilino group; an N-alkylanilino group; an N-acylanilino group; a hydroxy group or a mercapto group; l represents an integer of 1 to 4 and when l represents 2 to 4, the $R_{16}$'s of formula (IX) are the same or different; and X represents a hydrogen atom or a group capable of being released upon the coupling reaction with an oxidation product of an aromatic primary amine developing agent.

17. A silver halide color photographic material as claimed in claim 16, wherein $R_{15}$ represents a phenyl group which is substituted with an alkyl group, an alkoxy group or a halogen atom at at least one of the o-positions.

18. A silver halide color photographic material as claimed in claim 16, wherein Coupler (A') is a coupler represented by the general formula (IV) wherein $R_{14}$ represents an alkylamino group, an arylamino group, a cycloamino group or a heterocyclic amino group or a coupler represented by the general formula (V), and Coupler (B) is a coupler represented by the general formula (IV) wherein $R_{14}$ represents an acylamino group or a ureido group or a coupler represented by the general formula (VIII).

19. A silver halide color photographic material as claimed in claim 1, wherein a coupler employed in the red-sensitive silver halide emulsion layer unit is a cyan coupler represented by the following general formula (X), (XI) or (XII):

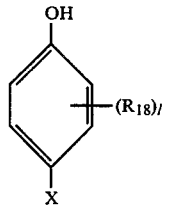

(X)

-continued

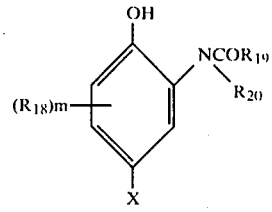

(XI)

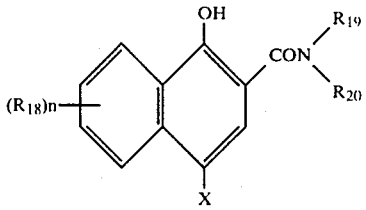

(XII)

wherein $R_{18}$ represents a hydrogen atom, a halogen atom, an aliphatic hydrocarbon residue, an acylamino group, a ureido group, an —O—$R_{21}$ group or an —S—$R_{21}$ group (wherein $R_{21}$ represents an aliphatic hydrocarbon residue), or $R_{18}$ may form a saturated or unsaturated carbocyclic or heterocyclic ring which may be substituted, when l or m is 2 or more; $R_{19}$ and $R_{20}$ each represents an aliphatic hydrocarbon residue, an aryl group or a heterocyclic group, one of $R_{19}$ and $R_{20}$ may be a hydrogen atom, or $R_{19}$ and $R_{20}$ may combine with each other to form a nitrogen-containing heterocyclic nucleus; l represents an integer of 1 to 4; m represents an integer of 1 to 3; n represents an integer of 1 to 5; and X represents a hydrogen atom or a group capable of being released upon the coupling reaction with an oxidation product of an aromatic primary amine developing agent.

20. A silver halide color photographic material as claimed in claim 18, wherein the aliphatic hydrocarbon group, the aryl group or the heterocyclic group represented by $R_{18}$, $R_{19}$ or $R_{20}$ may be substituted with a substituent selected from a halogen atom, a nitro group, a hydroxy group, a carboxy group, an amino group, a substituted amino group, a sulfo group, an alkyl group, an alkenyl group, an aryl group, a heterocyclic group, an alkoxy group, an aryloxy group, an arylthio group, an arylazo group, an acylamino group, a carbamoyl group, an ester group, an acyl group, an acyloxy group, a sulfonamido group, a sulfamoyl group, a sulfonyl group an a morpholino group.

21. A silver halide color photographic material as claimed in claim 19, wherein Coupler (A) or Coupler (A') is a coupler represented by the general formula (X) wherein an acylamino group or a ureido group is present at the 2-position and an alkyl group is present at the 5-position, and Coupler (B) is a coupler represented by the general formula (X) wherein an acylamino group or a ureido group is present at the 2-position and an acylamino group is present at the 5-position or a coupler represented by the general formula (XII) wherein $R_{19}$ represents a hydrogen atom, $R_{20}$ represents an aliphatic group, an aryl group or a heterocyclic group, or $R_{19}$ and $R_{20}$ may combine with each other and form a nitrogen-containing heterocyclic nucleus.

22. A silver halide color photographic material as claimed in claim 21, wherein the coupler represented by the general formula (X) for Coupler (A) or Coupler (A') further has a halogen atom at the 6-position, and the coupler represented by the general formula (X) for Coupler (B) further has a halogen atom at the 6-position or the coupler represented by the general formula (XII) for Coupler (B) further has a hydrogen atom for $R_{18}$.

23. A silver halide color photographic material as claimed in claim 16, wherein the coupler employed in the green-sensitive silver halide emulsion layer is a magenta coupler having the following formula (M-16):

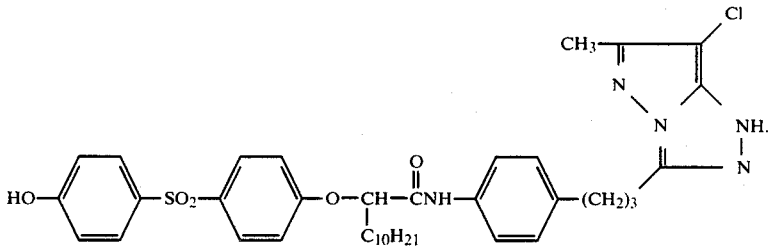

24. A silver halide color photographic material as claimed in claim 23, wherein the green-sensitive silver halide emulsion layer further contains 2,5-di-tert-hexylhydroquinone and trioctyl phosphate.

25. A silver halide color photographic material as claimed in claim 24, wherein the green-sensitive silver halide emulsion layer further contains 3,3,3',3'-tetramethyl-5,6,5',6'-tetrapropoxy-1,1'-bis-spiroindane.

26. A silver halide color photographic material as claimed in claim 24, wherein a gelatin-containing layer adjacent to the green-sensitive silver halide emulsion layer contains 2,5-di-tert-octylhydroquinone and trio-o-cresyl phosphate.

27. A silver halide color photographic material as claimed in claim 25, wherein a gelatin-containing layer adjacent to the green-sensitive silver halide emulsion layer contains 2,5-di-tert-octylhydroquinone and tri-o-cresyl phosphate.

28. A silver halide color photographic material as claimed in claim 25 where the dyes illustrate their maximum absorption when developed in an aromatic primary amine developing agent.

29. A silver halide color photographic material as claimed in claim 28 wherein the aromatic primary amine developing agent is a phenylene diamine derivative.

* * * * *